US010245491B2

(12) United States Patent
Scherba

(10) Patent No.: US 10,245,491 B2
(45) Date of Patent: Apr. 2, 2019

(54) INFLATABLE DOJO STRUCTURE

(71) Applicant: Scherba Industries, Inc., Brunswick, OH (US)

(72) Inventor: Robert Scherba, Brunswick, OH (US)

(73) Assignee: Scherba Industries, Inc., Brunswick, OH (US)

( * ) Notice: Subject to any disclaimer, the term of this patent is extended or adjusted under 35 U.S.C. 154(b) by 64 days.

(21) Appl. No.: 15/046,624

(22) Filed: Feb. 18, 2016

(65) Prior Publication Data

US 2016/0243421 A1 Aug. 25, 2016

Related U.S. Application Data

(63) Continuation-in-part of application No. 29/553,629, filed on Feb. 3, 2016, now Pat. No. Des. 803,340, which is a continuation-in-part of application No. 29/530,640, filed on Jun. 18, 2015, now Pat. No. Des. 762,801, which is a continuation-in-part of application No. 29/526,548, filed on May 11, 2015, now Pat. No. Des. 762,800.

(60) Provisional application No. 62/118,137, filed on Feb. 19, 2015.

(51) Int. Cl.
*A63B 17/00* (2006.01)
*A63B 69/00* (2006.01)

(52) U.S. Cl.
CPC ..... *A63B 69/004* (2013.01); *A63B 17/00* (2013.01); *A63B 2225/62* (2013.01)

(58) Field of Classification Search
CPC ..... A63B 2225/62; A63B 5/11; A63B 69/004; A63B 69/20; A63B 69/34; A63B 5/00
See application file for complete search history.

(56) References Cited

U.S. PATENT DOCUMENTS 4,701,787 A * 10/1987 Fujiwara ..... H04N 5/21 348/622
D365,400 S 12/1995 Scherba
5,555,679 A * 9/1996 Scherba ..... E04H 15/20 135/126
5,678,357 A * 10/1997 Rubio ..... E04H 15/20 40/212
5,772,535 A * 6/1998 Murphy ..... A63B 5/11 273/349
5,906,373 A * 5/1999 Sanders ..... A63B 67/00 273/349
D413,169 S 8/1999 Scherba
5,937,586 A 8/1999 Scherba (Continued)

*Primary Examiner* — Nyca T Nguyen
(74) *Attorney, Agent, or Firm* — Faye Sharpe LLP

(57) ABSTRACT

An inflatable device designed as a martial arts training and/or educational device. The inflatable device includes an inflatable structure and at least one interactive device connected to the inflatable structure. The inflatable structure includes a floor that is at least partially inflatable, a plurality of inflatable columns extending upwardly from the floor and a plurality of inflatable beams connected to a top or top portion of the columns. The at least one interactive device includes a target, an inflatable target, punching or kicking target, inflatable punching or kicking target, an object in the form of a person or ninja, an inflatable in the form of person or ninja, an object in the form of a person or ninja with a target, and/or an inflatable in the form of a person or ninja with a target.

1 Claim, 11 Drawing Sheets

(56) References Cited

U.S. PATENT DOCUMENTS

| | | | | |
|---|---|---|---|---|
| D422,667 | S * | 4/2000 | Lau | D21/814 |
| 6,478,685 | B1 * | 11/2002 | Ochi | A63G 31/00 472/134 |
| 6,527,418 | B1 | 3/2003 | Scherba | |
| 6,935,073 | B2 | 8/2005 | Scherba | |
| 7,114,276 | B2 | 10/2006 | Scherba | |
| 7,213,357 | B2 | 5/2007 | Scherba | |
| 7,231,739 | B2 | 6/2007 | Scherba | |
| 7,401,787 | B1 * | 7/2008 | Conte | A41D 13/0155 273/440 |
| D595,802 | S * | 7/2009 | Boulton | D21/835 |
| 7,611,427 | B1 * | 11/2009 | Cline | A63B 5/11 473/459 |
| D627,848 | S * | 11/2010 | Cline | D21/814 |
| 7,878,877 | B2 * | 2/2011 | Scherba | A63G 9/00 446/220 |
| 9,061,215 | B2 | 6/2015 | Scherba | |
| 2007/0087911 | A1 * | 4/2007 | Ghim | A63B 69/20 482/84 |
| 2010/0120323 | A1 * | 5/2010 | Boretskin | A63G 31/12 446/220 |
| 2015/0111655 | A1 * | 4/2015 | Coleman | A63G 31/12 472/134 |
| 2015/0148141 | A1 * | 5/2015 | Thompson | A63G 31/12 472/134 |
| 2016/0220883 | A1 * | 8/2016 | Anton | A63B 63/00 |

* cited by examiner

INFLATABLE DOJO STRUCTURE

The present invention claims priority to U.S. Provisional Application Ser. No. 62/118,137, filed on Feb. 19, 2015, and is a continuation-in-part of U.S. patent application Ser. No. 29/530,640, filed Jun. 18, 2015, U.S. patent application Ser. No. 29/526,548, filed May 11, 2015, and U.S. patent application Ser. No. 29/553,629, filed Feb. 3, 2016, which are all fully incorporated herein.

The present invention is directed to inflatable devices and more particularly to an inflatable device that can be used as a martial arts training device.

INCORPORATION BY REFERENCE

U.S. Pat. Nos. 9,061,215; 7,878,877; 7,231,739; 7,213,357; 7,114,276; 6,935,073; 6,527,418; 5,937,586; 5,555,679; D413,169 and D365,400 are incorporated herein fully by reference to illustrate inflatable devices, the manner in which such inflatable devices can be made, inflated and/or connected together, and types of components and/or accessories that can be used with such inflatable devices. Such inflatable devices and/or components and accessories for such inflatable devices can be used in the present invention.

BACKGROUND OF THE INVENTION

Health and fitness programs continue to be popular with individuals who wish to improve their health, fitness and mental well-being. One type of popular fitness program is martial arts. These types of programs can be beneficial to children; however, exposure to such programs generally requires the individual to attend a martial arts school. As such, exposure to these martial arts programs to the general population is limited unless the individual proactively seeks out such programs.

It would be advantageous to the public and teachers of martial arts programs to easily expose the public to the benefits of martial arts. It would also be advantageous to make the exposure to martial arts an enjoyable and exciting experience. This is especially true for younger individuals so as to entice them to learn more about martial arts, try out martial arts, and encourage them to attend a martial arts school.

In view of the prior art, there remains a need for a martial arts training device that can be used at a large number of locations, that can be configured in a variety of arrangements such that one or more people can learn about and experience martial arts, which can be easily assembled at various sites, and which can be easily disassembled for easy transport and storage.

SUMMARY OF THE INVENTION

The present invention relates to an inflatable device adapted and designed to be a portable martial arts training device that can be used to expose individuals to martial arts and to the enjoyment and health and fitness benefits of martial arts programs.

The present invention is directed to an inflatable device that incorporates one or more inflatable dojo-like structures that include one or more inflatable targets to enable individuals to have fun learning about martial arts and to test their skills. The portability of the inflatable structure allows the structure to be temporarily and/or permanently set up in and outside shopping centers, schools, churches, conventions, hotels, amusement parks, sports events, parks, and other locations where there are large groups of people in the near vicinity.

In another and/or alternative non-limiting aspect of the invention, the inflatable device can be formed in one or more structures that symbolize a traditional Japanese or Chinese structure. Non-limiting configurations of such structures can include, but are not limited to, an enclosure (e.g., an inflatable house, an inflatable building, etc.). The structure can be designed to accommodate one or more people in and/or about the inflatable device so that the one or more people can learn about and experience martial arts.

In another and/or alternative non-limiting aspect of the invention, the inflatable device can include a plurality of visual information (e.g., pictures attached to, printed on and/or projected on one or more walls; printed material attached to, printed on and/or projected on one or more walls; etc.) and/or interactive devices on the one or more walls, floors and/or ceilings, roof of the structure (e.g., inflatable punching and/or kicking targets, inflatable dojos, inflatable ninjas, inflatable dojos with targets, inflatable ninjas with targets, inflatable obstacles, slide, inflatable slide, bouncing area, inflatable bouncing area, climbing rope, ladder, inflatable ladder, climbing wall, inflatable climbing wall, climbing or sliding pole, inflatable climbing or sliding pole, etc.). These visual and/or interactive devices can be used as an information source, discussion source, teaching source, and/or activity element for exposing individuals to martial arts and its benefits. The visual and/or interactive devices can be used to provide entertainment to individuals before, during and/or after exposing the individuals to one or more types of visual and/or interactive devices; however, this is not required. The inflatable device can be inflated via blowers; however, this is not required.

In another and/or alternative non-limiting aspect of the invention, the inflatable device can include a plurality of physical activity features (e.g., inflatable punching and/or kicking targets, inflatable dojos, inflatable ninjas, inflatable dojos with targets, inflatable ninjas with targets, inflatable obstacles, slide, inflatable slide, bouncing area, inflatable bouncing area, climbing rope, ladder, inflatable ladder, climbing wall, inflatable climbing wall, climbing or sliding pole, inflatable climbing or sliding pole, etc.) arranged as an obstacle course; however, this is not required. The one or more physical activity features can be optionally attached to the inflatable structure and designed such that the one or more physical activity features may impede the movement of people moving through the obstacle course; however, this is not required. The obstacle course can be inflated via blowers; however, this is not required. As such, the blowers can maintain the inflation of the obstacle course components as one navigates the obstacles and move from one end of the obstacle course to the other; however, this is not required. The shape and size of the one or more physical activity features are non-limiting. The obstacle course arrangement (when used) can add to the fun and/or challenge of the experience.

In another and/or alternative non-limiting aspect of the invention, the inflatable device includes one or more support poles and/or structures to facilitate in maintaining the desired shape of the inflatable device. When large inflatable devices are used, the inflatable device can have a tendency to sway or move, especially when exposed to wind in an outdoor environment. The one or more support poles and/or structures are designed to reduce the movement of the inflatable device. In one non-limiting embodiment of the invention, the inflatable device includes one or more pockets that are designed to receive an end of one or more support poles or structures. In one non-limiting design, at least one pocket is located at or near a corner of the inflatable device. In another and/or alternative non-limiting embodiment of the invention, the inflatable device includes one or more guide tabs that are designed to maintain the one or more poles and/or structures in a desired position. The one or more guide tabs (when used) typically engage the one or more poles and/or structures between the ends of the one or more poles and/or structures; however, this is not required. In one non-limiting design, at least one guide tab includes a grommet through which the one or more poles and/or structures are inserted.

In another and/or alternative non-limiting aspect of the invention, the inflatable device optionally includes one or more windows.

In another and/or alternative non-limiting aspect of the invention, the inflatable device is a modular structure that can be attached to and detached from various other inflatable components. In one non-limiting embodiment of the invention, the inflatable device is formed of at least two inflatable components. In another and/or alternative non-limiting embodiment of the invention, two or more of the inflatable components that at least partially form the inflatable device of the present invention are at least partially releasably connected together. In still another and/or alternative non-limiting embodiment of the invention, at least one of the inflatable components that at least partially form the inflatable device of the present invention are at least partially releasably connected to one or more blowers. The one or more inflatable components of the inflatable device can take on a number of different shapes and sizes. Typically, the one or more inflatable components are at least partially formed from one or more panels; however, this is not required. In one aspect of this embodiment, the sides of the one or more panels (when used) are connected together to limit the amount of fluid leakage from the connected panel edges; however, this is not required. The one or more panels (when used) can be connected in a number of ways such as, but not limited to, a melted seam, glued edges, stitched edges, laced edges, zipped edges, Velcro-connected edges, snapped and/or buttoned edges, tongue and groove connected edges, hooked edges, etc. and/or by any combination of these arrangements. In another and/or alternative non-limiting aspect of this embodiment, the one or more panels (when used) include a flexible and durable material such as, but not limited to, coated nylon materials, coated Kevlar® materials, and/or the like. Such materials are generally flexible, durable, fluid repellant, and/or substantially fluid impermeable so as to be inflated and deflated without damage or with minimal damage, and/or are durable enough to resist wear and/or exposure to the elements over an extended period of time; however, this is not required. As can be appreciated, a wide variety of additional or other materials which are flexible, durable, fluid repellant, and/or substantially non-permeable to various fluids (e.g. liquid, gas, etc.) can be used by the present invention.

In another and/or alternative non-limiting aspect of this embodiment, the one or more inflatable components can include at least one fluid opening to enable a fluid to flow into and/or out of the inflatable component; however, this is not required. In accordance with a further and/or alternative non-limiting embodiment of the invention, two or more inflatable components of the inflatable device include a connector that at least partially allows fluid to pass between the modular components and allow the inflatable components to be at least partially releasably connected to one another; however, this is not required. In one non-limiting aspect of this embodiment of the invention, the connector (when used) includes a base having an opening that at least partially allows fluid to pass through the opening. In another and/or alternative non-limiting aspect of this embodiment of the invention, the base of the connector is connected to a blower or secondary inflatable component to which the inflatable component is to be connected; however, this is not required. When an inflatable component is to be connected to a blower, the base of the connector is typically formed on and/or connected to the end of the blower; however, this is not required. In still another and/or alternative non-limiting aspect of this embodiment, when one inflatable component is connected to another inflatable component, the base of the connector is formed on and/or connected to one of the inflatable components; however, this is not required. In yet another and/or alternative non-limiting aspect of this embodiment, the base of the connector can have a variety of shapes and/or sizes, and/or have a variety of opening sizes in the base. In still yet another and/or alternative non-limiting aspect of this embodiment, the base of the connector is at least partially formed from a durable material to resist wear; however, this is not required. Such materials can include, but are not limited to, hard plastic, rubber, fiberglass, metal and/or the like. In still yet a further and/or alternative non-limiting aspect of this embodiment, the base can include a connection flange adapted to be connected to an inflatable component, secondary inflatable component, and/or blower; however, this is not required. The connection flange (when used) typically fully extends around the perimeter of the base; however, this is not required. In still another and/or alternative non-limiting aspect of this embodiment, the base can include an extension wall that rises upwardly from the connection flange; however, this is not required. In yet another and/or alternative non-limiting aspect of this embodiment, the connection flange (when used) contacts the interior surface of the panel of an inflatable component when the connection flange is connected; however, this is not required. In still yet another and/or alternative non-limiting aspect of this embodiment, a fluid obstructer to inhibit fluid flow can be positioned on and/or about the fluid opening in the base; however, this is not required. The fluid obstructer (when used) is designed to interfere with the flow of fluid through the opening. Such a fluid obstructer can include, but is not limited to, a valve, a mesh material, filter material, semi-permeable material, and/or the like. The fluid obstructer (when used) can be used as a dampener to assist in ensuring an inflatable module remains inflated, etc.; however, this is not required. In accordance with still another and/or alternative non-limiting embodiment of the present invention, the connector can include a cap that is designed to at least partially releasably connect to the base of the connector; however, this is not required. In one non-limiting aspect of this embodiment, the cap (when used) is designed to at least partially secure one inflatable component to another inflatable component, and/or blower; however, this is not required. In another and/or alternative non-limiting aspect of this embodiment, the cap (when used) includes one or more openings to at least partially allow fluid to at least partially pass through the connector when the cap is at least partially releasably connected to the base; however, this is not required. In yet another and/or alternative non-limiting aspect of this embodiment, the cap (when used) includes a connection arrangement to at least partially releasably connect the cap to the base. The connection arrangement can take a number of different arrangements. The connection arrangement can include at least one thread on the cap so that the cap can be at least partially threaded on the base of the improved connector; however, this is not required. As can be appreciated, other and/or additional arrangements can be used to releasably connect the cap to the base of the improved connector. Such arrangements (when used) can include, but are not limited to, snaps, buttons, zippers, twist lock, connection rings, Velcro®, clamps, roping, locks, etc. In still another and/or alternative non-limiting aspect of this embodiment, the connection arrangement can include a securing flange on the cap and/or base which securing flange is used to releasably connect the base and the cap; however, this is not required. The cap can include a securing flange and/or the base can include a securing flange; however, this is not required. In still and/or alternative non-limiting aspect of this embodiment, the securing flange (when used) can include a connector to releasably secure to the cap or base or securing flange of the cap or base; however, this is not required. The connector (when used) can include a number of different arrangements such as, but not limited to, snaps, buttons, zippers, twist lock, connection rings, Velcro®, clamps, roping, locks, etc. In yet another and/or alternative non-limiting aspect of this embodiment, the cap (when used) can include a sealing flange that extends at least partially about the perimeter of the cap; however, this is not required. The sealing flange (when used) can be adapted to at least partially entrap and/or secure a portion of the panel of the inflatable component between the sealing flange and a portion of the base of the connector; however, this is not required. As such, the sealing flange (when used) can be designed to at least partially secure a portion of the inflatable component when the cap is releasably connected to the base; however, this is not required. The base of the improved connector can include a sealing landing that extends at least partially about the perimeter of the base; however, this is not required. The sealing landing (when used) can be adapted to at least partially entrap and/or secure a portion of the panel of the inflatable component between the sealing flange and the sealing landing when the cap is releasably connected to the base; however, this is not required. The connection flange of the base (when used) can also function as the sealing landing; however, this is not required. The sealing landing (when used) can be spaced from the connection flange of the base; however, this is not required. In this non-limiting design, the sealing landing (when used) can be positioned adjacent to, about, or below the connection flange. In still yet another and/or alternative non-limiting aspect of this embodiment, the cap (when used) can include a one or more gripping elements to facilitate in the insertion and/or removal of the cap from the base of the improved connector; however, this is not required. In accordance with still yet another and/or alternative non-limiting embodiment of the invention, at least one inflatable component can include a connection disk; however, this is not required. The connection disk (when used) can have a variety of shapes and/or sizes. The connection disk (when used) can include an opening that is at least partially aligned with and/or is in fluid communication with the fluid opening in the inflatable component; however, this is not required. In one non-limiting aspect of this embodiment, the connection disk can be designed to at least partially reinforce the region of the inflatable component and/or inhibit damage to the region of the inflatable component that is entrapped and/or secured between the base and the cap when the cap is releasably connected onto the base of the connector; however, this is not required. In another and/or alternative non-limiting aspect of this embodiment, the connection disk (when used) can be designed to at least partially inhibit or prevent the region of the inflatable component that is entrapped and/or secured between the base and the cap when the cap is releasably connected to the base of the connector from disengaging from the cap and/or base; however, this is not required. In still another and/or alternative non-limiting aspect of this embodiment, the connection disk (when used) can be at least partially made of a more rigid and/or resilient material than the material of the inflatable component; however, this is not required. In yet another and/or alternative non-limiting aspect of this embodiment, the connection disk (when used) can be at least partially made of the same or similar material as that of the inflatable component; however, this is not required. In still yet another and/or alternative non-limiting aspect of this embodiment, the connection disk (when used) can be secured to one or more inflatable components; however, this is not required. The connection disk (when used) can be secured to the inflatable component in any number of ways such as, but not limited to, a melted seam, adhesive, stitching, lacing, zipper, Velcro®, snaps and/or buttons, tongue and groove connection, hooks, connection rings, clamps, etc., and/or by any combination of these arrangements. In a further and/or alternative non-limiting aspect of this embodiment, the connection disk (when used) can be designed to be at least partially entrapped and/or secured between the base and the cap when the cap is releasably connected to the base of the connector; however, this is not required.

In another and/or alternative non-limiting embodiment of the invention, two or more inflatable components (when used) can be designed to be used with a joining arrangement that is designed to at least partially releasably secure the two or more inflatable components; however, this is not required. The joining arrangement (when used) can be designed to at least partially secure the inflatable components at a position at least partially spaced from the connector; however, this is not required. In one non-limiting aspect of this embodiment, the joining arrangement (when used) can be spaced from the connector; however, this is not required. In another and/or alternative non-limiting aspect of this embodiment, the joining arrangement (when used) can include one or more arrangements such as, but not limited to, lacing, zipper, rope, straps, Velcro®, snaps and/or buttons, tongue and groove connection, connection rings, hooks, etc. and/or by any combination of these arrangements; however, this is not required. The joining arrangement (when used) can include ropes, straps, lacing or the like at least partially connected to the inflatable component; however, this is not required. The rope, straps, lacing or the like (when used) are adapted to be connected to one or more connectors on the one or more secondary inflatable components. Such connectors (when used) can include, but are not limited to, hooks, grommets, loops, clamps, and/or the like. In one non-limiting design, the hooks, grommets, loops, clamps, and/or the like, when used, are connected to a flange, which in turn is connected to one inflatable component. The flange (when used) is typically flexible; however, this is not required. The flange (when used) can be made of the same or different material as one of the inflatable components. The flange (when used) typically is non-releasably secured to one of the inflatable components; however, this is not required. The flange (when used) can be designed to facilitate in the orienting of the hooks, grommets, loops, clamps, and/or the like relative to an inflatable component during the connection and disconnection process; however, this is not required. In another and/or alternative non-limiting aspect of this embodiment, the joining arrangement (when used) can include ropes, straps, lacing or the like at least partially connected to the secondary inflatable component; however, this is not required. The rope, straps, lacing or the like (when used) can be adapted to be connected to connectors on an inflatable component; however, this is not required. Such connectors can include, but are not limited to, hooks, grommets, loops, clamps, and/or the like. In one non-limiting design, the hooks, grommets, loops, clamps, and/or the like (when used) can be connected to a flange, which in turn is connected to the inflatable component; however, this is not required. The flange (when used) can be flexible; however, this is not required. The flange can be made of the same or different material as one of the inflatable components. The flange (when used) can be non-releasably secured to the inflatable component; however, it can be releasably secured to the inflatable component. The flange (when used) can be used to facilitate in the orienting of the hooks, grommets, loops, clamps, and/or the like relative to the one of the inflatable components during the connection and disconnection process; however, this is not required. In still another and/or alternative non-limiting aspect of this embodiment, the joining arrangement (when used) can be designed to be the primary arrangement to at least partially releasably secure two or more inflatable components. The connector (when used) can also be used to facilitate in securing together two or more inflatable components; however, this is not required. When the joining arrangement is used, the joining arrangement typically functions as the principal arrangement to at least partially releasably secure the inflatable components; however, this is not required.

In another and/or alternative non-limiting embodiment of the present invention, one or more inflatable components can include at least one access opening to enable an individual to insert the cap onto and/or remove the cap from the base of the connector during the connecting and/or disconnecting of the inflatable components and/or from a blower; however, this is not required. In one aspect this embodiment, the access opening (when used) can be located in at least one panel of the inflatable component and adjacent to the fluid opening of an inflatable component; however, this is not required. During the connection of one inflatable component with another inflatable component and/or blower, the fluid opening in the inflatable component can be inserted at least partially about the extension wall of the base of the connector; however, this is not required. The individual connecting the inflatable component to another component can place his/her hand through the access opening and guide the fluid opening in the inflatable component at least partially about the extension wall of the base of the connector; however, this is not required. Once the fluid opening is inserted about the extension wall of the base, the individual can then place his/her hand through the access opening and releasably secure the cap onto the base of the connector; however, this is not required.

In another and/or alternative non-limiting aspect of this embodiment, the access opening can be at least partially closable to at least partially inhibit fluid from passing through the access opening; however, this is not required. The access opening can be at least partially closed by, but not limited to, a zipper, Velcro®, buttons, snaps, hooks and/or the like; however, this is not required. In still another and/or alternative non-limiting aspect of this embodiment, an inflatable component can be connected to another inflatable component via the securing arrangement before or after the access opening is used to releasably secure the cap to the base; however, this is not required. When the inflatable component needs to be replaced and/or removed from another inflatable component, the above described sequence of steps can be reversed; however, this is not required.

In another and/or alternative non-limiting embodiment of the present invention, the connection arrangement (when used) can include a securing mechanism to inhibit or prevent the base and cap from inadvertently releasably connecting from one another; however, this is not required. Such securing arrangement (when used) can include a variety of arrangements such as, but not limited to, bolts, screws, pins, clips, snaps, connection rings, hooks, latches, roping, etc. and the like; however, this is not required.

In another and/or alternative non-limiting aspect of the present invention, the inflatable device can be used by itself or in combination with one or more other inflatable devices; however, this is not required. In one non-limiting embodiment of the invention, the sides of at least one inflatable device and one or more other inflatable devices can be aligned so that a fluid opening between the inflatable devices is at least partially aligned, thereby providing a passageway for the fluid between the interiors of the inflatable devices; however, this is not required. In another and/or alternative non-limiting embodiment of the invention, the fluid opening in one inflatable component (when such an opening exists) is typically smaller than the surface area of the panel the fluid opening is inserted therein, so as to create a pressure drop when the fluid passes through the fluid opening; however, this is not required. This type of fluid opening design can be used to facilitate in maintaining the inflatable component in a substantially fully inflated state. Furthermore, the inflatable component can be designed to resist deflating when one of the sides of the inflatable component is impacted; however, this is not required. This damping action of pressure differentials between two or more inflatable components can be used to help stabilize and maintain the integrity of the inflatable device; however, this is not required. In still another and/or alternative non-limiting embodiment, the fluid opening in the inflatable component can be positioned substantially in the center of the panel containing the fluid opening to provide a substantially uniform fluid flow and/or fluid pressure into and/or out of the inflatable component; however, the fluid opening can be positioned in other locations on the panel. In yet another and/or alternative non-limiting embodiment, a semi-permeable boundary can be positioned at least partially about the fluid opening to limit the fluid flow through the semi-permeable boundary; however, this is not required. In one aspect of this non-limiting embodiment, the semi-permeable boundary can include, but is not limited to, a mesh material, semi-fluid permeable material, and/or the like; however, this is not required.

In another and/or alternative non-limiting aspect of the present invention, one or more inflatable components of the inflatable device can be at least partially formed by multiple panels; however, this is not required.

In another and/or alternative non-limiting aspect of the present invention, one or more inflatable components of the inflatable device can include an air vacating arrangement which provides for quick deflation of the inflatable component being disassembled; however, this is not required. The air vacating mechanism (when used) can also be designed to allow access to the interior of the inflatable component for purposes of repair, assembly, disassembly, insertion of weights, etc.; however, this is not required.

In another and/or alternative non-limiting aspect of the present invention, one or more inflatable components of the inflatable device can include a support structure to support at least a portion of the inflatable component; however, this is not required. In one non-limiting embodiment of the invention, the support structure can include a pole support to at least partially support and/or secure a pole to the inflatable component; however, this is not required.

In another and/or alternative non-limiting aspect of the invention, the inflatable device can include one or more anchor points to secure the inflatable device in a particular position; however, this is not required. In one non-limiting embodiment of the invention, at least one anchor point can include a ring or loop that is adapted to be connected to a chain, cord rope and/or the like; however, this is not required. In one non-limiting aspect of this embodiment, a flexible material can be connected to the ring or loop at one end and connected to the inflatable device at another end; however, this is not required. In another and/or alternative non-limiting embodiment of the invention, one or more anchor points are positioned at or near the base of the inflatable device; however, this is not required. In still another and/or alternative non-limiting embodiment of the invention, one or more anchor points can be positioned above the base of the inflatable device; however, this is not required. In yet another and/or alternative non-limiting embodiment of the invention, one or more anchor points can be positioned at or near an edge of the inflatable device; however, this is not required.

In another and/or alternative non-limiting aspect of the invention, the inflatable device includes a floor that is at least partially or fully inflatable; however, this is not required. The front portion of the inflatable device includes one or more inflatable structures that make the inflatable structure appear to be representative of a dojo and/or associated with martial arts. In one non-limiting configuration, the front and/or rear of the inflatable structure includes a pair of inflatable columns or posts and an inflatable lintel or inflatable angled or curve beam structure connected to the top or top portion of the column or post. As can be appreciated, the inflatable column or post can include both an inflatable lintel and an inflatable angled or curve beam structure connected to the top or top portion of the column or post. In another non-limiting arrangement, a pair of inflatable columns or posts are positioned at or near the front of the inflatable floor of the inflatable device and spaced inwardly from the side of the inflatable floor of the inflatable device, and the inflatable lintel or inflatable angled and/or curve beam structure that is connected to the top or top portion of the column or post extends outwardly from each of the columns or posts and also extends beyond each of the side edges of the inflatable floor of the inflatable device. In another non-limiting arrangement, the inflatable structure includes two or more pairs of inflatable columns or posts connected to a top surface of the inflatable floor and wherein each pair of inflatable columns or posts includes the inflatable lintel or inflatable angled and/or curve beam structure that is connected to the top or top portion of the column or post.

In another and/or alternative non-limiting aspect of the invention, the inflatable device includes a floor that is at least partially or fully inflatable and two or more inflatable walls that are connected to a top surface of the inflatable floor and extend upwardly from the top surface inflatable floor; however, this is not required. In one non-limiting arrangement, one or more of the side walls are positioned between and connected to two inflatable columns or posts that are connected to a top surface of the inflatable floor. One or more of the inflatable walls can include a plurality of openings that resemble a window; however, this is not required. In another non-limiting arrangement, the inflatable structure includes at least two inflatable side walls and an inflatable back wall connected to a top surface of an inflatable floor, and an activity area positioned between the side walls. In another non-limiting arrangement, the inflatable device includes an inflatable roof that extends at least 60% (e.g., 60%-100% and all values and ranges therebetween) of the distance between the front and back edge of the inflatable floor. The inflatable roof is spaced upwardly from the top surface of the inflatable floor. The inflatable roof can optionally include one or more openings. Generally, the inflatable roof overlies or covers at least 20% (e.g., 20%400% and all values and ranges therebetween) of the top surface of the inflatable floor, typically at least 40% of the top surface of the inflatable floor, and more typically about 60%-100% of the top surface of the inflatable floor.

In another and/or alternative non-limiting aspect of the invention, the inflatable device includes one or more exterior inflatable targets extending outwardly from a side edge of the inflatable floor; however, this is not required. Over 50% (e.g., 50.1%-100% and all values and ranges therebetween) of the exterior inflatable target is positioned above a top surface of the side edge of the inflatable floor and/or over 50% (e.g., 50.1%-100% and all values and ranges therebetween) of the exterior inflatable target extends outwardly from the side edge of the inflatable floor such that most of the inflatable target does not overlie the tope surface of the inflatable floor. The shape and size of the inflatable target is non-limiting. In one non-limiting arrangement, the target has a generally circular shape and has a diameter of 0.5-5 ft. and all values and ranges therebetween; however, this is not required. As can be appreciated, other shapes of the external inflatable target can be used (e.g., target in the form of an inflatable person or ninja, target in the form of an inflatable head of a person or ninja, target in the form of an inflatable door, target in the form of an inflatable bar or wood beam, etc.). When the inflatable target in not in the form of a target having a circular face, the at least a portion of the width of the inflatable target is at least 0.5 ft. (e.g., 0.5-5 ft and all values and ranges therebetween) so that an individual can easily kick or punch the inflatable target. In another non-limiting arrangement, the front face of the inflatable target that is designed to be primarily kicked or punched is positioned non-parallel (e.g., 30°-150°) to the top surface of the inflatable floor. In one specific arrangement, the front face of the inflatable target is positioned perpendicular (e.g., 90°) to the top surface of the inflatable floor. In another non-limiting arrangement, the front face of the inflatable target is positioned parallel to the top surface of the inflatable floor. The inflatable device can include a plurality of exterior inflatable targets extending outwardly from a side edge of the inflatable floor wherein all of the exterior inflatable targets are positioned non-parallel to the top surface of the inflatable floor, all of the exterior inflatable targets are positioned parallel to the top surface of the inflatable floor, or one or more of the exterior inflatable targets are positioned non-parallel to the top surface of the inflatable floor, and one or more of the exterior inflatable targets are positioned parallel to the top surface of the inflatable floor. The front face and/or back face of the exterior inflatable target can include printed material (e.g., head, face, body, rings of a target, picture of a door, picture of a window, etc.); however, this is not required. In another non-limiting arrangement, one or more of the inflatable exterior targets can be connected to inflatable columns or posts that are connected to a top surface of the inflatable floor, or connected to an inflatable roof structure.

In another and/or alternative non-limiting aspect of the invention, the inflatable device includes one or more interior inflatable targets that are positioned on and/or over the inflatable floor; however, this is not required. Over 50% (e.g., 50.1%-100% and all values and ranges therebetween) of the interior inflatable target is positioned above a top surface of the inflatable floor. The interior inflatable target can be connected to the top surface of the inflatable floor, positioned above the top surface of the inflatable floor by connection to a side wall, column, roof structure, and/or lintel or beam structure. As can be appreciated, the interior inflatable target can be connected to both the inflatable floor and to a side wall, column, roof structure, and/or lintel or beam structure. The shape and size of the interior inflatable target is non-limiting. In one non-limiting arrangement, the target has a generally circular shape and has a diameter of 0.5-5 ft. and all values and ranges therebetween; however, this is not required. As can be appreciated, other shapes of the internal inflatable target can be used (e.g., target in the form of an inflatable person or ninja, target in the form of an inflatable head of a person or ninja, target in the form of an inflatable door, target in the form of an inflatable bar or wood beam, etc.). When the inflatable target in not in the form of a target having a circular face, the at least a portion of the width of the inflatable target is at least 0.5 ft. (e.g., 0.5-5 ft and all values and ranges therebetween) so that an individual can easily kick or punch the inflatable target. In another non-limiting arrangement, the front face of the inflatable target that is designed to be primarily kicked or punched is positioned non-parallel (e.g., 30°-150°) to the top surface of the inflatable floor. In one specific arrangement, the front face of the inflatable target is positioned perpendicular (e.g., 90°) to the top surface of the inflatable floor. In another non-limiting arrangement, the front face of the inflatable target is positioned parallel to the top surface of the inflatable floor. The inflatable device can include a plurality of interior inflatable targets extending outwardly from a side edge of the inflatable floor wherein all of the interior inflatable targets are positioned non-parallel to the top surface of the inflatable floor, all of the interior inflatable targets are positioned parallel to the top surface of the inflatable floor, or one or more of the interior inflatable targets are positioned non-parallel to the top surface of the inflatable floor, and one or more of the interior inflatable targets are positioned parallel to the top surface of the inflatable floor. The front face and/or back face of the interior inflatable target can include printed material (e.g., head, face, body, rings of a target, picture of a door, picture of a window, etc.); however, this is not required. In another non-limiting arrangement, one or more of the inflatable interior targets can be connected to an inflatable columns or posts that are connected to a top surface of the inflatable floor, or connected to an inflatable roof structure. In one non-limiting specific embodiment, the interior inflatable target is in the form of a person or ninja hanging (e.g., hanging upside down, hanging from its hands, etc.) from the ceiling or roof of the inflatable structure and positioned above the top surface of the inflatable floor. In another non-limiting specific embodiment, the interior inflatable target is in the form of a person or ninja hanging from the side of the inflatable structure and positioned above the top surface of the inflatable floor. In another non-limiting specific embodiment, the interior inflatable target is in the form of a person or ninja connected to the top surface of the inflatable floor. In another non-limiting specific embodiment, the interior inflatable target is in the form of a person or ninja connected to the top surface of the inflatable floor and also to the side wall, column or post, and/or the roof structure of the inflatable device.

In another and/or alternative non-limiting aspect of the invention, the inflatable device includes one or more inflatable obstacles; however, this is not required. The form and shape of the inflatable obstacles are non-limiting (e.g., inflatable tube, inflatable climbing wall, inflatable sloped climbing wall, inflatable slide, inflatable bars positioned over and above the top surface of the floor, etc.). Generally, a majority (e.g., 50.01-100%) of the one or more inflatable obstacles are fully positioned over the top surface of the floor; however, this is not required. Generally, one or more of the inflatable obstacles are connected to the top surface of the floor; however, this is not required.

One non-limiting objective of the present invention is to provide an at least partially inflatable device that can function as a martial arts education and/or entertainment device.

Another and/or alternative non-limiting objective of the present invention is to provide a temporary inflatable device that can be used in many different locations to introduce individuals to martial arts.

Yet another and/or alternative non-limiting objective of the present invention is to provide an inflatable device that can be configured in many different configurations to introduce individuals to martial arts.

Still yet another and/or alternative non-limiting objective of the present invention is to provide an inflatable device that can be stored in small locations.

These and other objectives will become apparent to those skilled in the art upon reading and following the description taken together with the accompanied drawings.

BRIEF DESCRIPTION OF THE DRAWINGS

Reference may now be made to the drawings which illustrate various non-limiting embodiments that the invention may take in physical form and in certain parts and arrangement of parts wherein.

DESCRIPTION OF THE NON-LIMITING EMBODIMENTS

Figure 1:
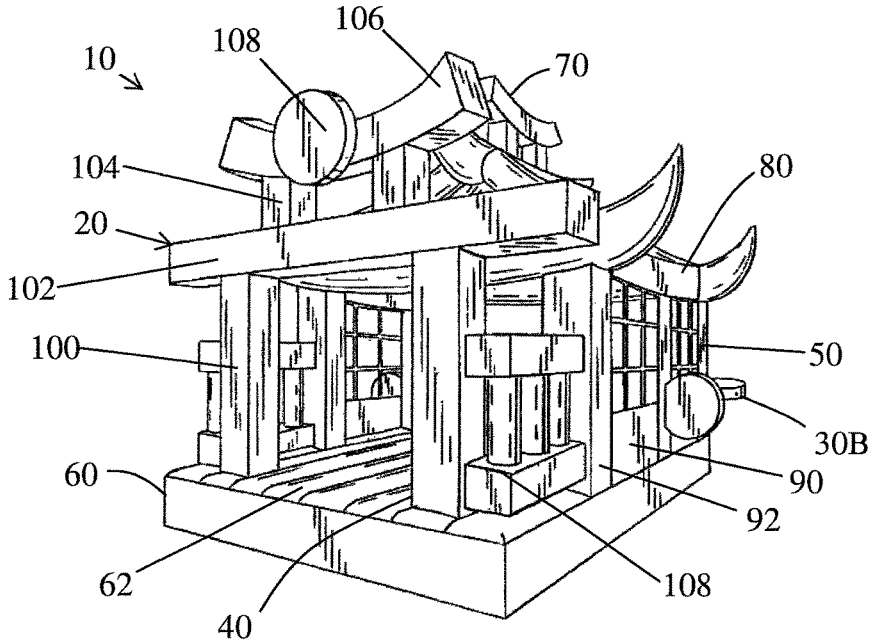
FIG. 1 is a front elevation perspective illustration of one non-limiting inflatable martial arts training facility according to the present invention.

Referring now to the drawings, wherein the showings are for the purpose of illustrating one non-limiting embodiments of the invention only and not for the purpose of limiting the invention, FIGS. 1-21 illustrate a martial arts training device 10 comprising an inflatable martial arts structure and various inflatable devices that can be used in and/or in conjunction with the martial arts structure in accordance with the present invention.

As illustrated in FIGS. 1-21, the inflatable device of the present invention can be designed to be used as a martial arts training device. The martial arts training device is formed from at least two inflatable structures: an inflatable structure 20 and at least one inflatable interactive device 30 that is connected to the inflatable structure. The structures that form the inflatable structure are generally fluidly connected together so that the most if not all of the structures that form the inflatable structure can be inflated at the same time. Also, the majority or all of the inflatable interactive devices that are connected to the inflatable structure are fluidly connected to one or more structures of the inflatable structure so that, as the inflatable structure is inflated, one or more or all of the inflatable interactive devices are also inflated. As can be appreciated, one or more or all of the inflatable interactive devices can be optionally independently inflated from the inflatable structure. As can also be appreciated, one or more of the inflatable interactive devices can be optionally inflated independently from one another. Furthermore, one or more portions of the inflatable structure can optionally be inflated independently from one another. The inflatable structure is at least partially enclosed; however, this is not required. The one or more interactive devices can include a target, an inflatable target, inflatable punching and/or kicking target, dojos, inflatable dojos, ninjas, inflatable ninjas, inflatable dojos with targets, ninjas with targets, inflatable ninjas with targets, or combinations thereof. As can be appreciated, the inflatable martial arts training device can include other or additional inflatable structures. The one or more interactive devices 30 can be formed as part of the inflatable structure 20, or can be separate inflatable devices that can optionally be attached or connected to the inflatable structure 20.

With continued reference to FIGS. 1-6, inflatable structure 20 is a one-room, partially enclosed structure (e.g., a training facility, etc.); however, inflatable structure 20 can be a multi-room and/or multi-level structure. Inflatable structure 20 may include one or more regions that do not include a wall and/or roof. The one or more interactive devices 30 can be partially inflatable, fully inflatable, or non-inflatable. Similarly, inflatable structure 20 can be partially inflatable, fully inflatable, or non-inflatable.

Inflatable structure 20 is in the form of an inflatable one-room structure that is used to simulate a martial arts dojo. Inflatable structure 20 can be at least partially enclosed. The inflatable structure 20 can include at least one entrance 40. The entrance may or may not include a door. Generally, steps, inflatable steps, a ramp, an inflatable ramp, etc. can be positioned in front of the entrance to facilitate access to the entrance of structure 20; however, this is not required. Inflatable structure 20 can include one or more windows 50; however, this is not required. Inflatable structure 20 can include at least one wall 90. Generally, inflatable structure 20 includes at least two walls, more typically at least three walls, and even more typically four walls; however, this is not required. As can be appreciated, the structure can include more than four walls or less than four walls depending on the design and look desired and/or needed for the inflatable structure. Not all sides of the structure are required to have a wall. As such, one or more sides of the inflatable structure could be without a wall if so desired. In some non-limiting embodiments, the one or more sides of the inflatable structure without a wall can define the entrance to the inflatable structure; however, this is not required. One or more of the walls can be partially inflatable, fully inflatable, or non-inflatable. As such, the one or more inflatable walls can be designed to at least partially enclose said inflatable structure and form an interior and exterior inflatable wall surface. When the structure includes one or more windows and/or doors, the one or more windows and/or doors are generally formed in the one or more walls. As can be appreciated, one or more fake windows and/or fake doors can be drawn, painted and/or printed on said one or more walls; however, this is not required.

The structure can include one or more columns 92 that are connected to the top surface 62 of the inflatable floor 60 and extends upwardly from the top surface. The columns can be sewn, stitched, bonded, and/or connected in other ways to the top surface of the inflatable floor. Generally, the one or more columns are in fluid communication with the inflatable floor; however, this is not required.

Figure 4:
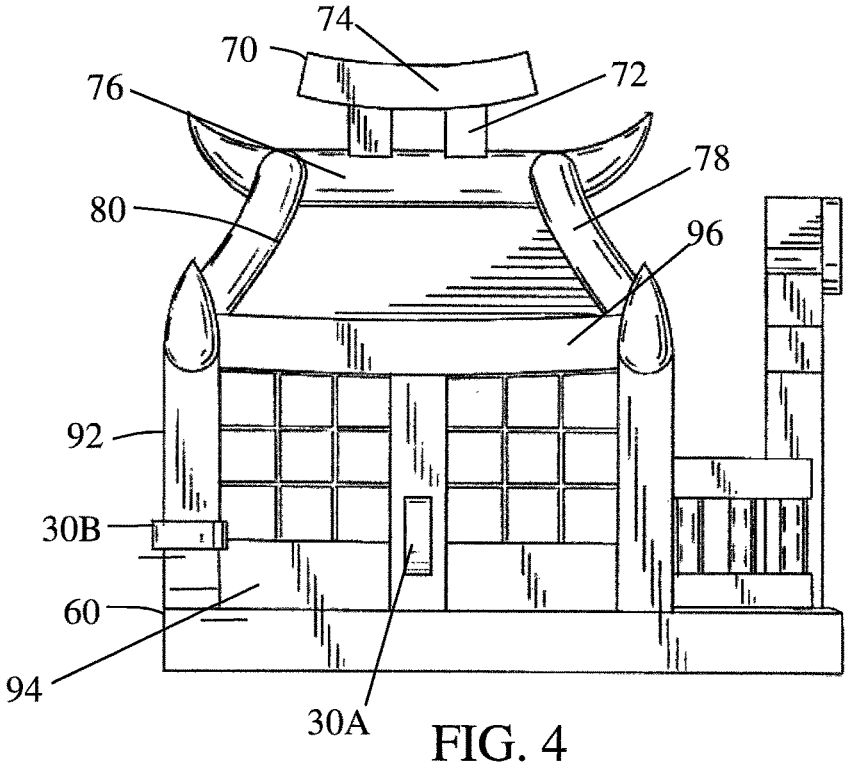
FIG. 4 is a side view perspective illustration of an inflatable martial arts training facility of FIG. 1.

As best illustrated in FIG. 4, the side of the inflatable structure 20 includes a side wall 90 formed of two wall sections 94 that are each connected between three columns 92. The type of connection is non-limiting. Generally, the columns are in fluid communication with the side walls; however, this is not required. As can be appreciated, the side wall of the inflatable structure can include only one side wall section or more than two side wall sections and can include less than three columns or more than three columns. In one non-limiting arrangement, when inflated, the columns 92 may be substantially cylindrical in shape. However, as can be appreciated, the shape of the columns can be non-cylindrical, rectangular, square, triangular, or any other shape desired or needed. When the cylindrical shape is used, the columns 92 can have a diameter of from about 0.5 foot to about 3 feet, more particularly from about 1 feet to about 2 feet. The length of each of the side wall sections is non-limiting (e.g., 1-20 ft., and all values and rages therebetween). The height of the column and side walls is also non-limiting. Generally, the height is at least 1 foot and typically is 3-20 ft. and all values and rages therebetween.

Figure 3:
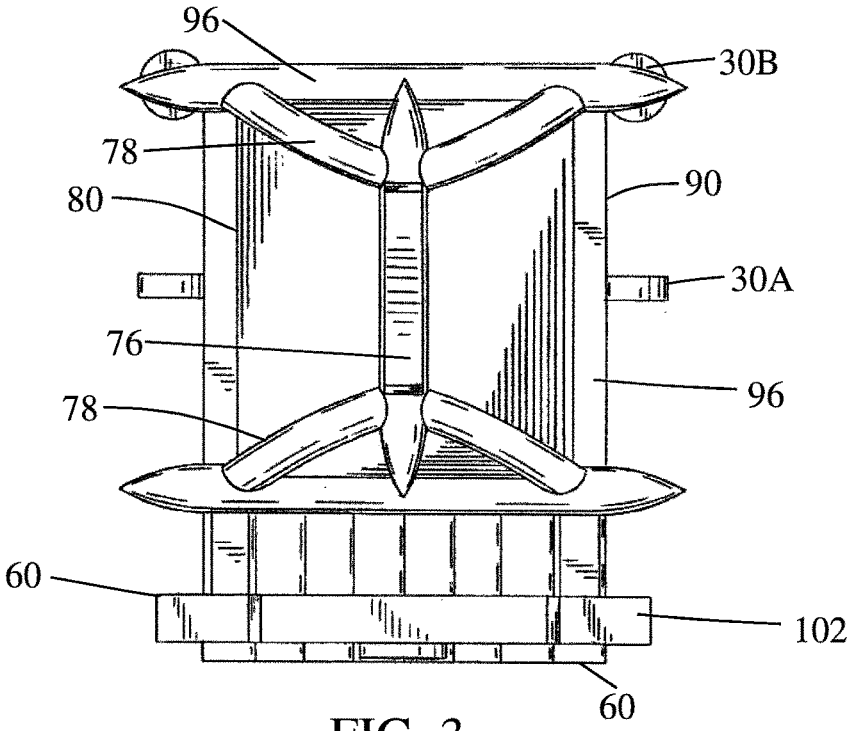
FIG. 3 is a top plan perspective illustration of an inflatable martial arts training facility of FIG. 1.
Figure 5:
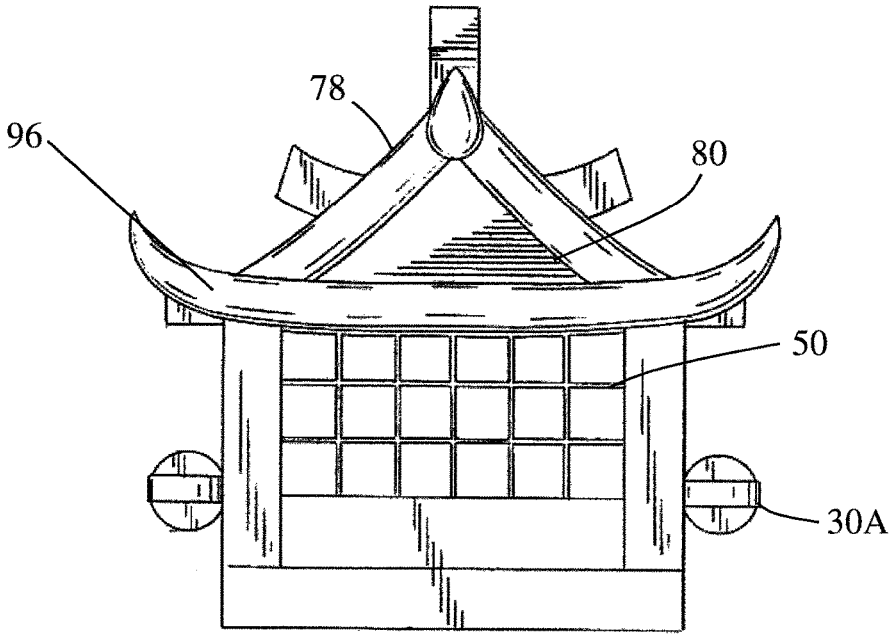
FIG. 5 of a rear plan perspective illustration of an inflatable martial arts training facility of FIG. 1.
Figure 6:
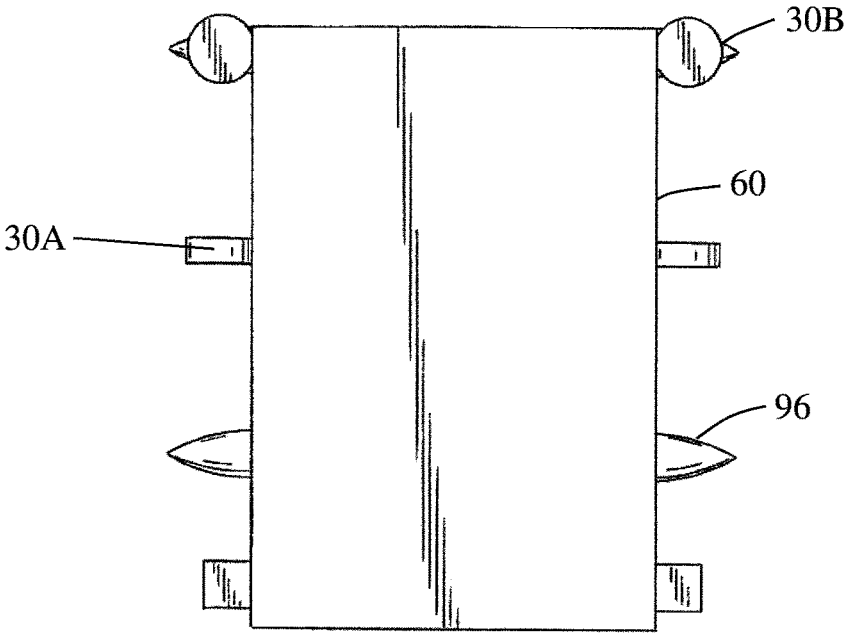
FIG. 6 is a bottom plan perspective illustration of an inflatable martial arts training facility of FIG. 1.

Connected to the top or top portion of the columns is a lintel or an angled or curved beam structure 96. As illustrated in FIGS. 3-5, a lintel or straight beam is positioned along the sides of the inflatable structure and the angled or curved beams are positioned on the front or back sides of the inflatable structure and are connected between the side walls; however, this is not required. As illustrated in FIG. 3, the ends of the angled or curved beams extend past the side of the column and curve upwardly; however, this is not required. As also illustrated in FIG. 3, the ends of the angled or curved beams extend also past the side edge of the floor 60; however, this is not required.

The inflatable structure 20 includes an inflatable floor 60; however, this is not required. The inflatable floor 60 (when used) can fully cover or partially cover the activity floor region of the inflatable structure 20. The activity floor region is generally defined as the area of the floor that is located between the one or more inflatable walls. In one non-limiting embodiment, the inflatable floor may be sized to extend beyond the one or more walls; however, this is not required. As such, the inflatable floor can have a length and/or width greater than at least part of the area enclosed by the one or more walls to provide increased support for the inflatable structure. The inflatable floor can be partially inflatable, fully inflatable, or non-inflatable. The inflatable floor can be continuous or semi-continuous. At least one part of the top surface of the inflatable floor can have a variety of different designs (e.g., wood-panel look, concrete look, tile look, gravel look, etc.); however, this is not required. The design of one or more portions of the top surface of the inflatable floor can be used to create a visual representation of the inflatable structure 20 (e.g., a martial arts dojo, etc.).

Inflatable floor 60 can optionally be composed of one or more layers; however, this is not required. As such, the inflatable floor 60 can include a base layer which may be puncture resistant and provide additional cushioning and support to the one or more overlaying top layers; however, this is not required. Additionally, the one or more floor layers can have a combinatory effect wherein a bouncing effect of the inflatable floor is greatly amplified or the support provided by the inflatable floor dramatically improves the stability of said inflatable structure. As such, in some non-limiting embodiments, the floor 60 can be used to add stability to the inflatable structure 20 while also providing points of attachment for one or more interactive devices 30; however, this is not required.

The inflatable structure 20 can include a roof 80; however, this is not required. The roof (when used) can fully cover or partially cover the floor 60 of inflatable structure 20. Generally, the roof (when used) covers at least about 25% of the floor of the inflatable structure 20, typically at least about 50% of the floor of the inflatable structure, and more typically at least about 75% of the floor of the martial arts training structure. In some designs, the roof (when used) covers 100% of the floor of the inflatable structure. The roof 80 can be a partially inflatable, fully inflatable, or non-inflatable structure. The roof 80 can be formed of one or more components and/or roof ornaments 70. The roof ornaments 70 (when used) can add visual attributes to the inflatable structure for the purpose of symbolizing a traditional Japanese or Chinese structure; however, such roof ornaments are not required. The roof ornaments (when used) can be partially inflatable, fully inflatable, or non-inflatable. Non-limiting roof ornaments include two base pillars 72 that support an arcuate beam 74 as illustrated in FIG. 4. The roof ornament can also or alternatively include a base arcuate beam 76. As illustrated in FIG. 4, the base beam is positioned under and supports the two base pillars 72. Roof support beams 78 can be used to secure the roof ornaments 70 in position. One end of the roof support beam can be connected to the columns 92 and/or the beam structure 96. The roof support beams can be inflatable; however, this is not required. As illustrated in FIG. 4, the roof support beams and the roof ornaments are inflatable.

In non-limiting arrangements, the roof 80 can be used to add stability to the inflatable structure 20 while also providing points of attachment for one or more interactive devices; however, this is not required.

Figure 2:
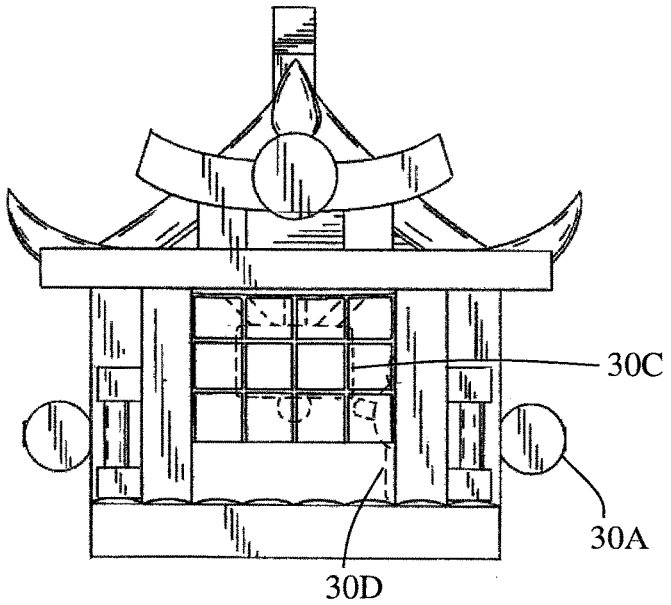
FIG. 2 is a front plan perspective illustration of an inflatable martial arts training facility of FIG. 1.

The front of the inflatable structure 20 can include an entrance formed of two or more front pillars or columns 100 that are spaced inwardly from the side edge of the floor 60 and also spaced inwardly from the sidewalls 90 and columns 92. These front columns can be inflatable. The front columns are also spaced from the columns 92 as illustrated in FIGS. 1 and 4. A connection structure 108 can optionally be connected between the front columns 100 and sidewalls 90. The connection structure can be inflatable. As illustrated in FIGS. 1 and 4, the connection structure looks similar to a weapons rack at a ninja facility; however, it can be appreciated that other configurations can be used. A lintel or an angled or curved beam structure 102 is connected at or near the top of front columns 100 and is generally an inflatable structure. As illustrated in FIG. 2, a lintel or straight beam is positioned on the top of front columns 100 and the ends extend past the sides of the front column; however, this is not required. As illustrated in FIG. 3, the ends of the lintel or straight beam 102 also extend beyond the side edge of the floor 60; however, this is not required. As illustrated in FIG. 2, an ornamental structure can optionally be positioned on top of the lintel or an angled or curved beam structure 102. The roof ornaments (when used) can be partially inflatable, fully inflatable, or non-inflatable. Non-limiting roof ornaments include two base pillars 104 that support an arcuate beam 106 having a circular disk 108 positioned on the front face of the arcuate beam as illustrated in FIGS. 1 and 2.

One or more interactive devices 30 can be provided on the one or more walls, floors and/or roof of inflatable structure 20. The one or more interactive devices 30 can have a general shape and printing on at least one outside surface to convey an appearance of a target to a user; however, this is not required. Interactive devices 30 can include a target, an inflatable target, punching and/or kicking target, inflatable punching and/or kicking target, a ninja, an inflatable ninja, ninjas with targets, inflatable ninjas with targets, ramp, inflatable ramp, inflatable ramp with surface projections, etc. As can be appreciated, the one or more interactive devices 30 can have many other configurations. The one or more interactive devices (when used) can be the same and/or different. The interactive devices (when used) can be partially inflatable, fully inflatable, or non-inflatable. The interactive devices, (when used) can be located on an interior and/or exterior of said inflatable structure. One or more of the outside surfaces of interactive devices 30 can have a variety of different colors and/or designs; however, this is not required. In one non-limiting embodiment, the interactive device 30 has a general shape and printing on at least one outside surface to convey the appearance of a ninja; however, this is not required. In another non-limiting embodiment, the interactive device 30 has a general shape and printing on at least one outside surface to convey the appearance of a ninja with a target; however, this is not required. In yet another non-limiting embodiment, the outside surface of the targets can be made to look human-like; however, it can be appreciated that the outside of the target can have other illustrations and/or designs. The one or more interactive devices 30 are illustrated as being at least partially connected to at least one component of inflatable structure 20; however, this is not required. The interactive devices can be releasably connected to the one or more walls, floor, and/or roof of said inflatable structure such that fluid can flow between the one or more interactive devices and the inflatable structure; however, this is not required.

As illustrated in FIG. 1-6, a plurality of external interactive devices 30A, 30B are positioned on the outer surface of the side walls 90 or columns 92 and extend outwardly from the side edge of the floor 60. The external interactive devices are generally connected to column 92; however, this is not required. The external interactive devices are illustrated as being positioned at a level that is above the top surface of the floor; however, this is not required. The external interactive devices are illustrated as being circular inflatable disks having different orientations. External interactive devices 30A are circular disks wherein the front and back faces are generally oriented perpendicular to the top surface of the floor. External interactive devices 30B are circular disks wherein the front and back faces are generally oriented parallel to the top surface of the floor. As can be appreciated, the front and/or back face of the circular disks can optionally include printed material such as a target, etc. As can be appreciated, the shapes of the external interactive devices can be the same or different. As also can be appreciated, shapes other than circular disks can be used for the external interactive devices. Each side of the inflatable structure includes one or more external interactive devices; however, this is not required.

Figure 13:
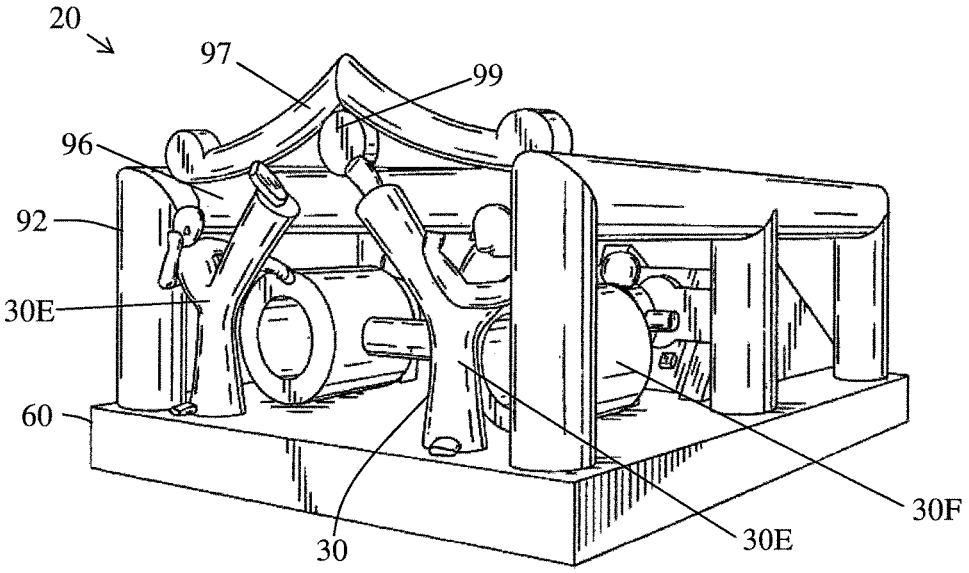
FIG. 13 is a front elevation perspective illustration of another non-limiting inflatable martial arts training facility arranged as an obstacle course according to the present invention.
Figure 19:
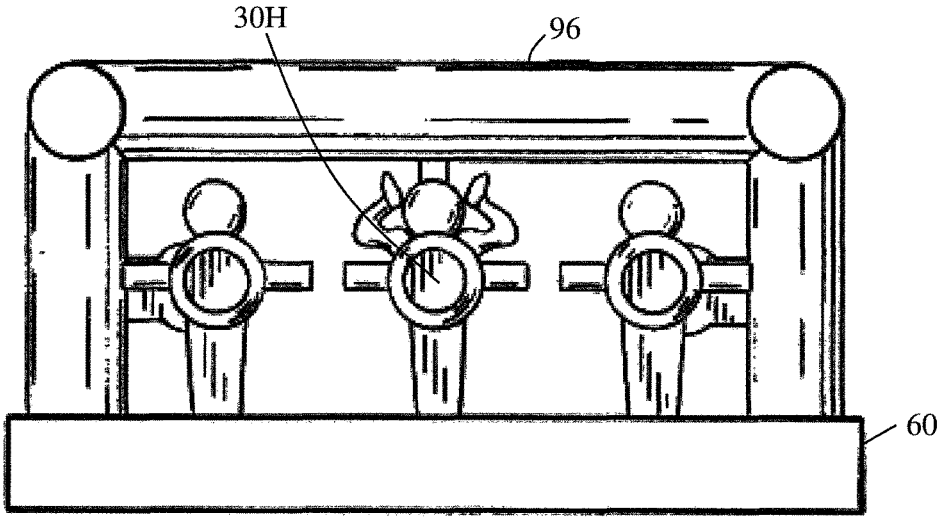
FIG. 19 is a cross-section perspective illustration taken along 19-19 of FIG. 14.
Figure 20:
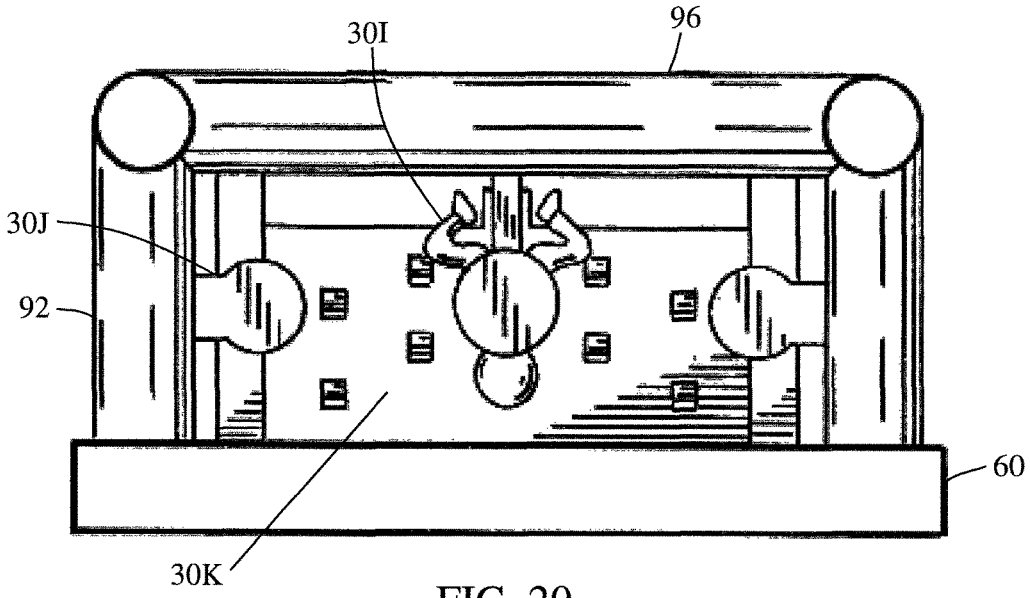
FIG. 20 is a cross-section perspective illustration taken along 20-20 of FIG. 14; and, FIG. 21 is a cross-section perspective illustration taken along 21-21 of FIG. 14.
Figure 21:
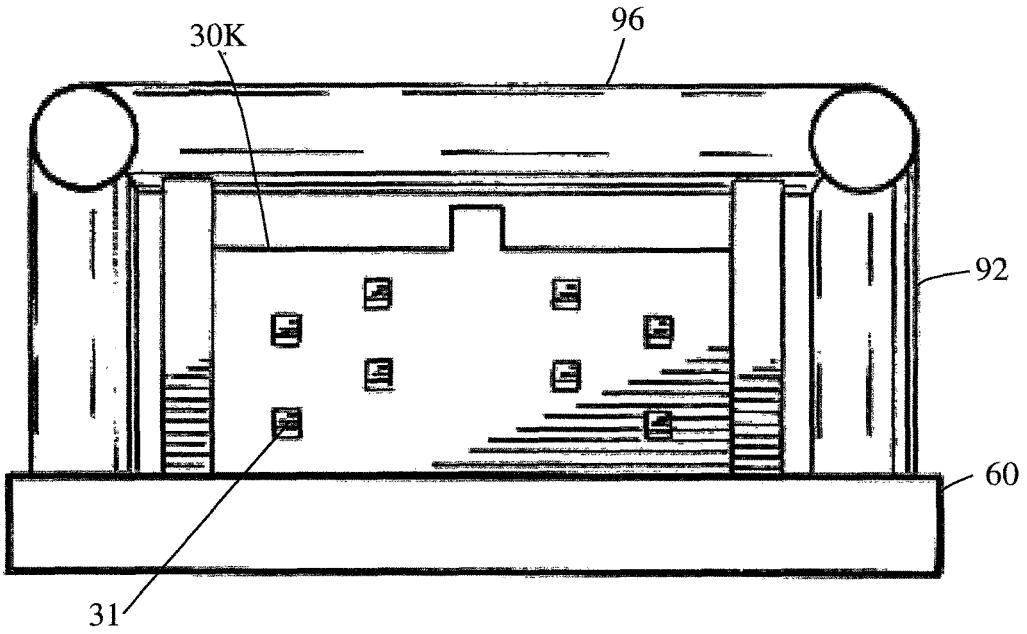

As illustrated in FIG. 2 in dashed lines, one or more internal interactive devices can be used. The shape of at least one of the internal interactive devices is different from the shape of one or more of the external interactive devices; however, this is not required. As illustrated in FIG. 2, one of the internal interactive devices 30C is shaped as a person or ninja hanging from the ceiling of the inflatable structure. Another example of such an internal interactive device is illustrated in FIG. 20. Internal interactive devices 30C can be spaced from the top surface of the floor as illustrated in FIG. 20 or also be connected to the floor as illustrated in FIG. 19. As can be appreciated, internal interactive devices 30C can also or alternatively be connected to the inner surface of the side wall 90 or column 92. As illustrated in FIG. 2, another one of the internal interactive devices 30D is shaped as a person or ninja standing on the floor of the inflatable structure. Another example of such an internal interactive device is illustrated in FIG. 19. The internal interactive devices 30D can only be connected to the floor or also or alternatively be connected to the inner surface of the side wall 90 or column 92. FIG. 19 illustrates six internal interactive devices. Two of the internal interactive devices are connected to the side wall or columns and are the general shape of a disc having an extension leg that connects to the side wall or column as best illustrated in FIG. 20. Three of the internal interactive devices are connected to the floor and are in the general shape of a person having an upper spherical portion that resembles a head of a person, a central cylindrical portion that represents a body of a person, a tapering bottom portion that is connected to the floor and represents the legs of a person, and two tubular structures extending outwardly from the cylindrical portion and representing the arms of a person. The two internal interactive devices that are positioned closest to the side walls can have one of the tubular structures connected to the side wall or column as illustrated in FIG. 19. One of the internal interactive devices is in the general shape of a person hanging upside-down from the ceiling of the inflatable structure. The internal interactive device has a lower spherical portion that resembles a head of a person, a central cylindrical portion that represents a body of a person, a top portion that is connected to a lintel or an angled or curved beam structure 96 and/or other structure in the ceiling or roof so connect the internal interactive device to the ceiling or roof. The top portion can be representative of the legs of a person, or inflatable legs can be connected to the central cylindrical portion as illustrated in FIG. 20. The lower spherical portion is illustrated as being positioned and spaced above the top surface of the floor. As can be appreciated, other or additional internal interactive devices can be used in the inflatable structure. For example, as illustrated in FIG. 13, tubular cylinders can be used, elevated bars can be used, structures that resemble a person high kicking can be used, and many others. All of the internal interactive devices described can be inflatable and can be fluidly connected to the floor, ceiling, columns and/or sidewalls.

Figure 7:
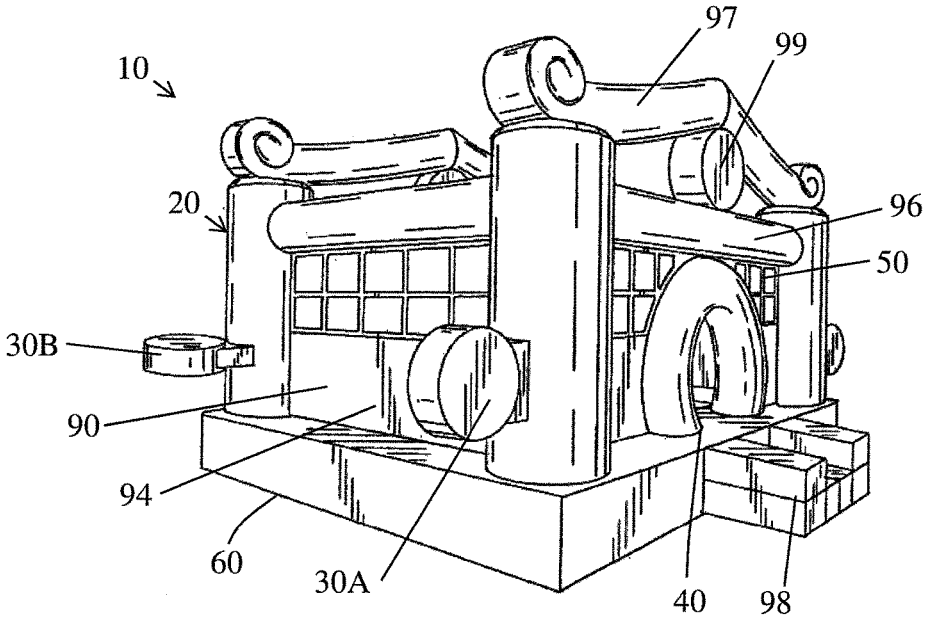
FIG. 7 is a front elevation perspective illustration of another non-limiting inflatable martial arts training facility according to the present invention.
Figure 8:
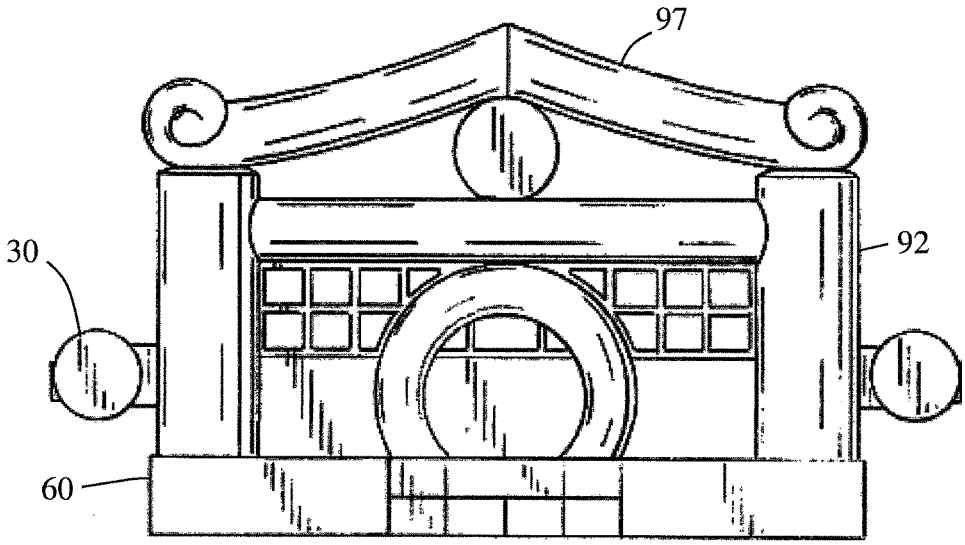
FIG. 8 is a front plan perspective illustration of an inflatable martial arts training facility of FIG. 7.
Figure 9:
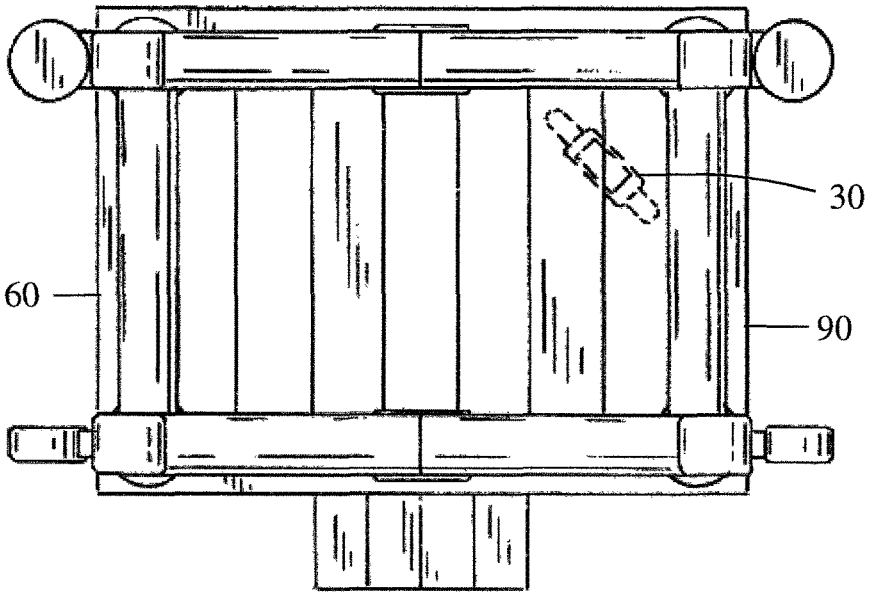
FIG. 9 is a top plan perspective illustration of an inflatable martial arts training facility of FIG. 7.
Figure 10:
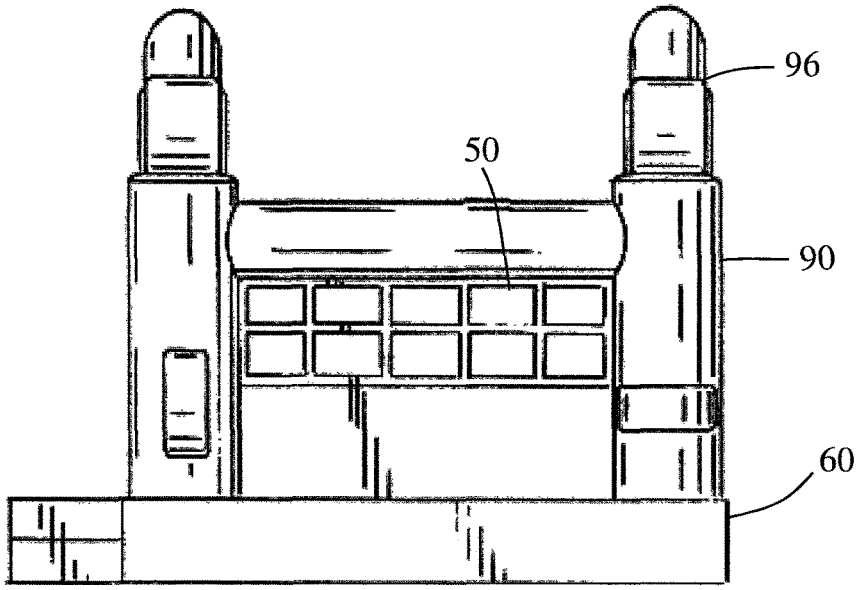
FIG. 10 is a side view perspective illustration of an inflatable martial arts training facility of FIG. 7.
Figure 11:
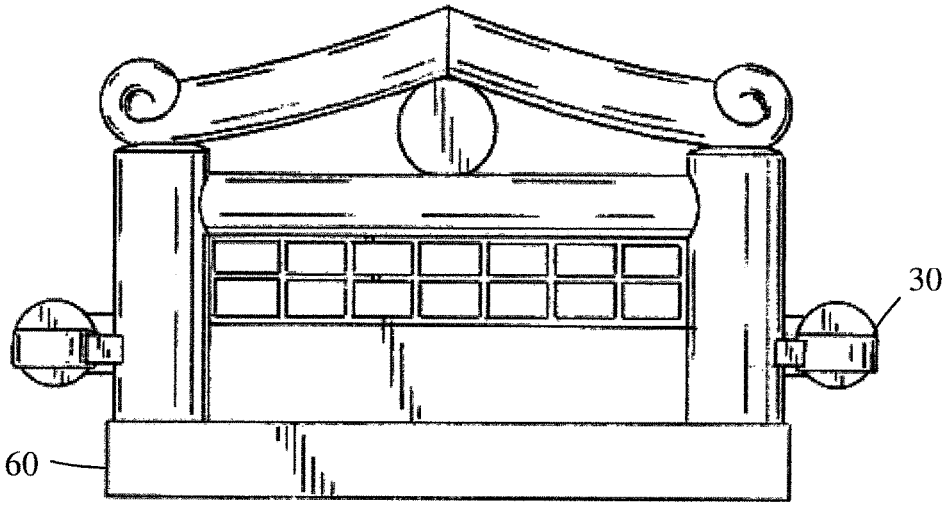
FIG. 11 of a rear plan perspective illustration of an inflatable martial arts training facility of FIG. 7.
Figure 12:
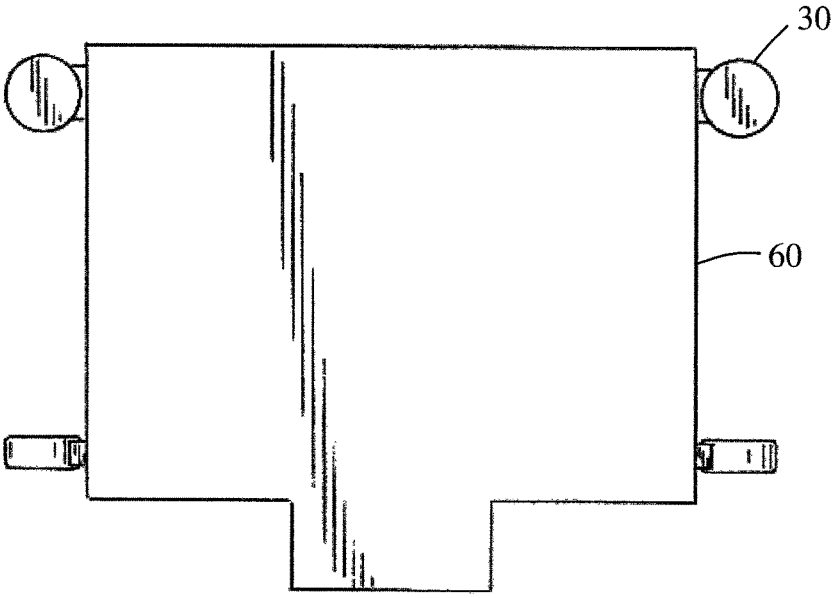
FIG. 12 is a bottom plan perspective illustration of an inflatable martial arts training facility of FIG. 7.

Referring now to FIGS. 7-12, another non-limiting inflatable structure 10 is illustrated. This inflatable structure is a more simplified version of the inflatable structure illustrated in FIGS. 1-6, but still has many of the same structures. The inflatable device of FIGS. 7-12 is absent a roof and the roof ornaments 70. The inflatable device of FIGS. 7-12 is also absent front pillars or columns 100 and the structures connected thereto. The inflatable device of FIGS. 7-12 does include an inflatable floor 60, side walls 90, columns 92, lintel or an angled or curved beam structure 96, and interior and exterior interactive devices. The types of interior and exterior interactive devices can be the same or similar to the interior and exterior interactive devices described with respect to the inflatable device of FIGS. 1-6. As illustrated in FIGS. 7 and 10, the inflatable structure only has one side wall portion 94 that is located between two columns 92; however, this is not required.

The front of the inflatable device has a circular opening; however, this is not required. A step portion 98 which can be inflatable is positioned in front of the opening; however, this is not required. As can be appreciated, a similar or modified inflatable step could also be positioned in the front of the inflatable structure of FIGS. 1-6.

The front of the inflatable structure includes a lintel or straight beam 96 connected at or near the top of the columns 92 and a secondary angled or curve beam structure 97 that is positioned above the straight beam 96. A circular disk 99 can optionally be positioned between and connected to the straight beam 96 and secondary angled or curve beam structure 97. A similar arrangement can optionally be located on the back of the inflatable structure.

Referring now to FIGS. 13-21, the inflatable structure can be in the form of an obstacle course wherein an individual can enter the front of the inflatable structure, traverse one or more interior interactive devices, and exit at the back of the inflatable structure. In such an arrangement, the inflatable structure can optionally be absent exterior interactive devices, side wall portions, and a back wall; however, this is not required. Similar to the inflatable device illustrated in FIGS. 7-12, the inflatable device of FIGS. 13-21 does not include a roof; however, it can be appreciated that the inflatable structure can include a roof. The front of the inflatable structure includes a lintel or straight beam 96 connected at or near the top of the columns 92 and optionally includes a secondary angled or curved beam structure 97 that is positioned above the straight beam 96. A circular disk 99 can optionally be positioned between and connected to the straight beam 96 and secondary angled or curve beam structure 97. A similar arrangement can optionally be located on the back of the inflatable structure.

The one or more internal interactive devices can be designed to define a path for an obstacle course arrangement; however, this is not required. As illustrated in FIG. 13, the front entrance of the inflatable structure includes two internal interactive devices 30E that resemble a person high kicking that are positioned on both sides of the entrance. The internal interactive devices include a top round or cylindrical portion that resembles the head of a person, a body portion, and two leg portions connected to the body portion, wherein one leg extends downwardly to the floor and generally connected to the floor and the other leg extends upwardly to resemble a person kicking upwardly. The head and/or body can be connected to column 92.

As illustrated in FIGS. 14-21, various internal interactive devices can be used in the inflatable structure. The one or more internal interactive devices can be attached to an interior surface and/or an exterior surface of the inflatable structure 20. As one non-limiting example, the one or more interactive devices can be attached to and extend from one or more beam, one or more inflatable walls, one or more inflatable columns, the inflatable floor, and/or from other inflatable interactive devices. The internal interactive devices can be attached at any angle to any component of the inflatable structure.

Figure 15:
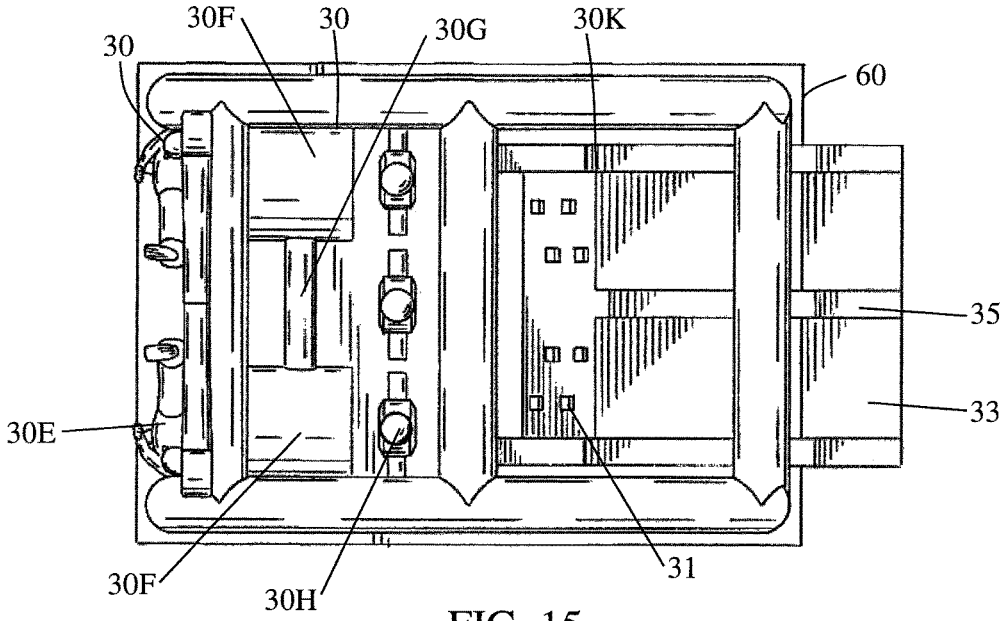
FIG. 15 is a top plan perspective illustration of an inflatable martial arts training facility of FIG. 13.
Figure 16:
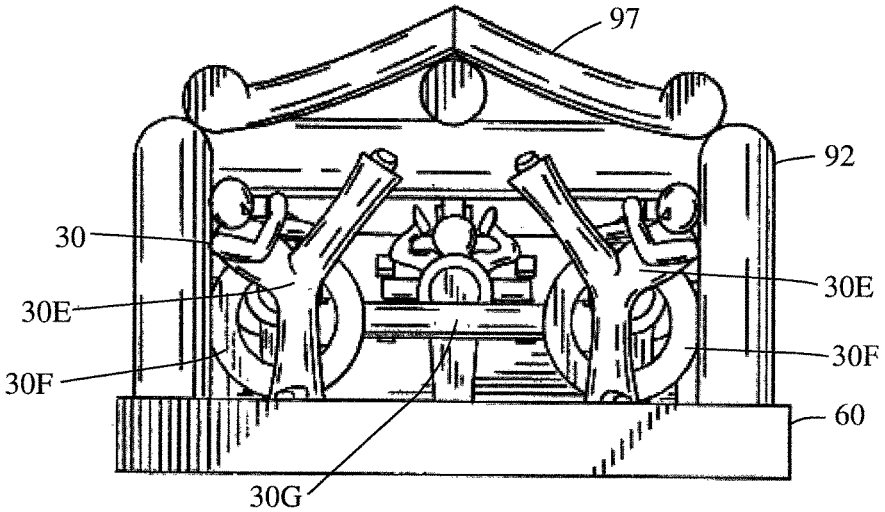
FIG. 16 is a front plan perspective illustration of an inflatable martial arts training facility of FIG. 13.
Figure 17:
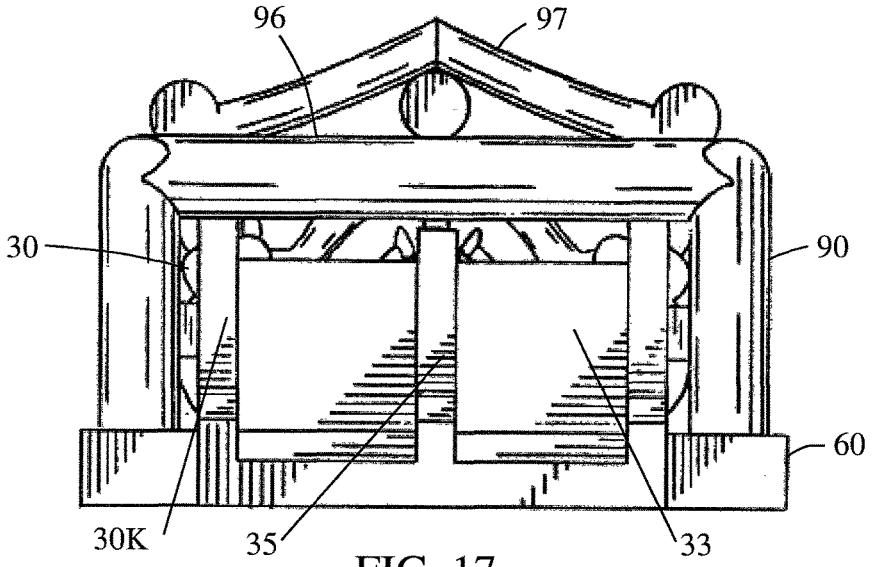
FIG. 17 is a rear plan perspective illustration of an inflatable martial arts training facility of FIG. 13.
Figure 18:
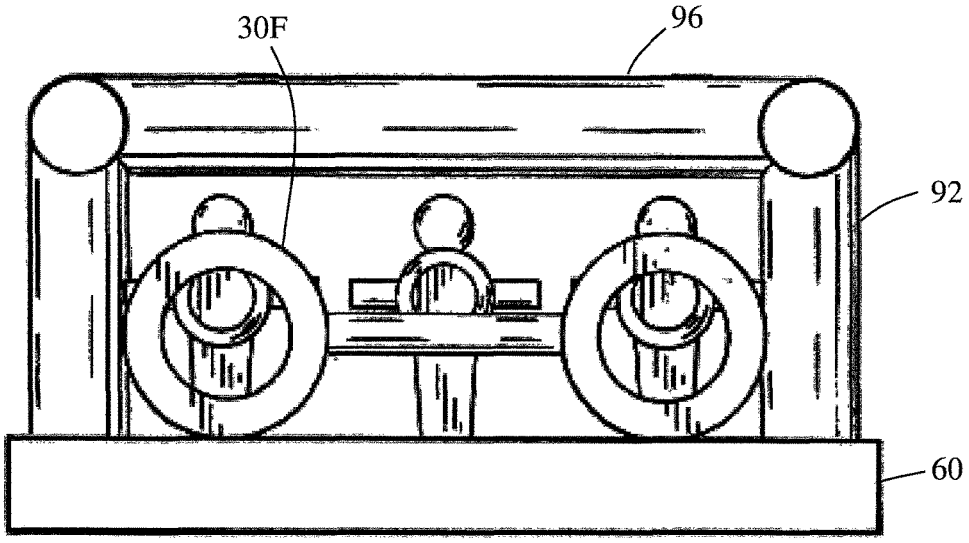
FIG. 18 is a cross-section perspective illustration taken along 18-18 of FIG. 14.

As illustrated in FIGS. 15 and 16, the obstacle course can have two or more courses to facilitate in racing others; however, this is not required. As shown in FIGS. 15 and 16, the two side courses have similar obstacles between the front and back of the inflatable structure, and the middle course has one or more different obstacles for, the two side courses. As can be appreciated, multiple courses (when used) can have the same obstacles or each of the courses can include a different combination of obstacles. As illustrated in FIGS. 15 and 16, each of the courses has at least four (4) obstacles. Generally, each course has a plurality of different obstacles; however, this is not required. Each course can have the same number of obstacles; however, this is not required. As illustrated in FIGS. 15-21, the two side obstacle courses have five (5) obstacles and the center obstacle course has four (4) obstacles.

As best illustrated in FIG. 16, the two side obstacle courses begin with obstacle 30E in the form of a figure that appears to be performing a high kick. This obstacle is an inflatable obstacle that includes a generally spherically top portion that resembles a person's head. Connected below the generally spherically top portion is a body portion that resembles the central portion of a person. The generally spherically top portion and/or the body portion are connected to column 92. One or two tubular structures that resemble arms can be connected to the body portion. Connected to the bottom of the body portion are two larger tubular structures that resemble the legs of a person. One of the larger tubular structures is engaged and is generally connected to the top surface of the floor. The other larger tubular structure angles upwardly from the body portion to resemble a high kick. The top end or portion of the other larger tubular structure may not be connected to any other structure or could be connected to beam structure 96. During an obstacle course run, individuals running on the side obstacle courses must climb over, go under or around obstacle 30E to get to the next obstacle. Although not specifically considered an obstacle, individuals must jump, climb, etc. onto the top of the inflatable floor to begin the obstacle course. Some may consider getting onto the top surface of the floor a first obstacle. Although not shown, steps as illustrated in FIG. 7 can be optionally used to facilitate in enabling individuals to gain access to the top surface of the floor.

Positioned rearwardly of obstacles 30E, are obstacles 30F and 30G. Obstacles 30F are in the form of an inflatable tube having a generally cylindrical shape. The opening through the inflatable tube allows an individual to crawl, run or walk through the inflatable tube. The diameter of the opening is generally 2-5 ft., and all values and ranges therebetween; however, other diameters can be used. As can be appreciated, the tube can have other cross-sectional shapes (e.g., square, oval, etc.). The diameter of the opening in the inflatable tube is generally constant along the length of the inflatable tube; however, this is not required. As illustrated in FIGS. 15 and 16, the inflatable tubes 30F are positioned on each side of the inflatable structure. The inflatable tubes are generally connected to the floor. Positioned between the inflatable tubes is another obstacle 30G in the form of an inflatable bar. The inflatable bar is connected at each end of the inflatable tubes and is positioned above the top surface of the floor. The inflatable tube is designed to be jumped over, crawled over or slid under by an individual. The diameter of the tube is generally constant at about 0.5-2 ft. and all values and ranges therebetween; however, other diameters can be used. As can be appreciated, the cross-section shape of the tube can be other than circular (e.g., oval, square, etc.) and can vary in diameter or size along the length of the tube; however, this is not required. During the running of the obstacle course for individuals running on the side obstacles courses, the inflatable tubes 30F are the second obstacle to pass after passing obstacle 30E. For individuals running on the central obstacle course, inflatable bar 30G is the first obstacle.

As best illustrated in FIGS. 14, 15, 18 and 19, an inflatable obstacle 30H in the form of a standing person is illustrated. The obstacles have an upper spherical portion that resembles a head of a person, a central cylindrical portion that represents a body of a person, a tapering bottom portion that is connected to the floor and represents the legs of a person, and two tubular structures extending outwardly from the cylindrical portion and representing the arms of a person. The two obstacles 30H that are positioned closest to the side walls can have one of the tubular structures connected to the side wall or column as illustrated in FIG. 19. The bottom portion of obstacle 30H is connected to the floor. Obstacle 30H is designed to be run, walked or crawled about. The central cylindrical portion can be used as a kicking and/or punching target and can include print that appears as a target for practicing a kick or punch on a certain region of the target; however, this is not required. The two outwardly extending tubular structures can be jumped over or crawled, walked or run under. Obstacle 30H represents the third obstacle for the side obstacle courses and the second obstacle for the central obstacle course.

Referring now to FIG. 20, there is an inflatable obstacle 30I that is in the shape of a person or ninja hanging from the ceiling of the inflatable structure. Obstacle 30I is positioned rewardly of obstacle 30H. Obstacle 30I has a lower spherical portion that resembles a head of a person, a central cylindrical portion that represents a body of a person, a top portion that is connected to a lintel or an angled or curved beam structure 96 and/or other structure in the ceiling or roof to connect the internal interactive device to the ceiling or roof. The top portion can be representative of the legs of a person, or inflatable legs can be connected to the central cylindrical portion as illustrated in FIG. 20. The lower spherical portion is illustrated as being positioned and spaced above the top surface of the floor. The central cylindrical portion can be used as a kicking and/or punching target and can include print that appears as a target for practicing a kick or punch on a certain region of the target; however, this is not required. Obstacle 30I represents the third obstacle for the central obstacle course. Obstacle 30I is configured to be run, walked or crawled under, or can be walked or run around.

Positioned on both sides of the obstacle 30I is inflatable obstacle 30J. Obstacle 30J is in the form of a cylindrical structure having a side leg that is connected to a column. The cylindrical portion can be used as a kicking and/or punching target and can include print that appears as a target for practicing a kick or punch on a certain region of the target; however, this is not required. Obstacle 30J represents the fourth obstacle for the side obstacle courses. Obstacle 30J is configured to be run, walked or crawled under, or can be run or walked around.

Figure 14:
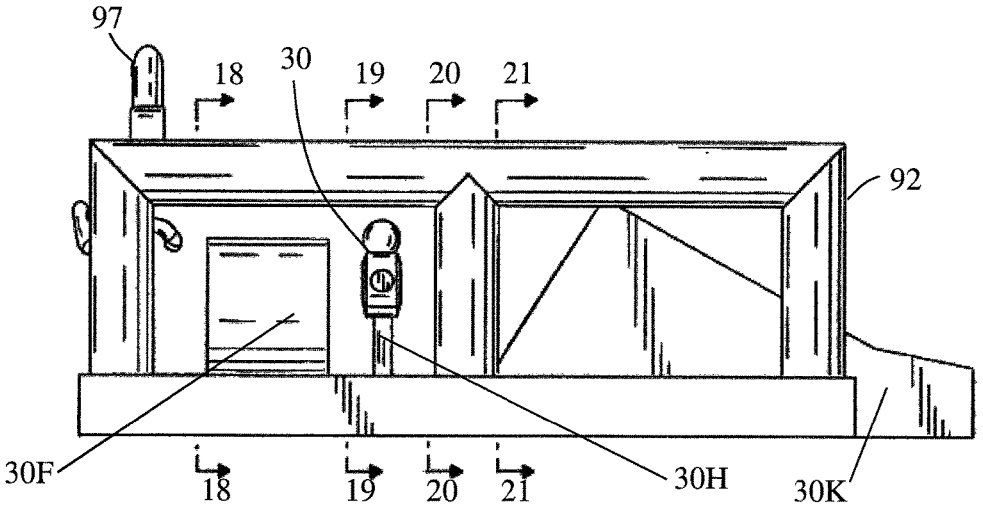
FIG. 14 is a side view perspective illustration of an inflatable martial arts training facility of FIG. 13.

As best illustrated in FIGS. 14, 15, 17 and 21, the last inflatable obstacle 30K is in the form of a wall and slide. The front side of obstacle 30K can resemble a rock climbing wall that includes one or more protrusions 31 that can be used as footing or grasping surfaces when climbing the wall; however, this is not required. As illustrated in FIG. 14, the front face of obstacle 30K can be sloped; however, this is not required. The back side of obstacle 30K includes two slide portions 33 that slope downwardly from the top portion of the wall and the two slide portions are optionally separated by an elevated divider 35. As can be appreciated, obstacle 30K can include a single slide or more than two slides. The end of the slide portion of obstacle 30K is illustrated as extending past the back end of the floor; however, this is not required. Obstacle 30K represents the last obstacle for the side obstacle courses and the central obstacle course.

One or more of the walls, floor, roof 80, and/or interactive devices of inflatable device 10 illustrated in FIGS. 1-21 can include various types of visual information. One type of information can be visual safety information (e.g., warning to not hit or kick others, warnings about what objects can be hit, kicked, or climbed on, etc.); however, this is not required. Another type of information can be visual technique information regarding various martial arts moves and/or poses; however, this is not required. The visual safety and/or technique information can be printed on, attached to, etc. the interior and/or exterior surfaces of the one or more of the walls, columns, ceiling, etc. of the inflatable structure. Typically, the printed information is in color; however, this is not required. The one or more walls, columns, and/or ceiling of the inflatable structure can include one or more drawings and/or images illustrating proper safety and/or technique, etc. in martial arts; however, this is not required. As can be appreciated, other or additional materials can be printed and/or attached to the walls, columns, and/or ceiling of the inflatable structure to provide visual examples for purposes of discussing safety and/or martial art techniques. As such, the inflatable structure can be used as an information source, discussions source, teaching source, activity element for exposing individuals to martial arts and its benefits, or combinations thereof.

The outside of the inflatable structure 20 can include printed material and/or attachments to make the inflatable structure have a certain look; however, this is not required. As such, the inflatable device can have a shape and/or printing on at least one outside surface and at least one inside surface to simulate a martial arts dojo.

FIGS. 13-21 illustrate various non-limiting embodiments of the inflatable device obstacle course arrangement, at least one of which may include a plurality of interactive devices 30. The one or more interactive devices 30 can be the same and/or different. Like numbers used in FIGS. 1-12 can correspond to like features of the embodiment shown in FIGS. 13-21.

With reference to FIGS. 13-21, the inflatable structure 20 can include a plurality of physical activity features and/or interactive devices (e.g., slides, inflatable slides, climbing rope, ladder, inflatable ladder, tunnels, inflatable tunnels, bridges, inflatable bridges, beams, inflatable beams, ninjas, inflatable ninjas, ramps, inflatable ramps, tunnels, inflatable tunnels, obstacles, inflatable obstacles, etc.) arranged as an obstacle course such that the one or more physical activity features and/or interactive devices may impede the movement of one or more people moving through the course. The one or more physical activity features can be partially inflatable, fully inflatable, or non-inflatable. The obstacle course arrangement (when used) can add to the enjoyment and/or challenge of the martial arts experience provided by the inflatable device 10. The obstacle course arrangement (when used) can be inflated on site at an event (e.g., sports events, parks, etc.) and deflated after said event is over.

With continued reference to FIGS. 13-21, in some non-limiting embodiments, the one or more physical activity features and/or one or more interactive devices may be attached to the inflatable floor (see at least FIGS. 1-19), the inflatable walls (see at least FIG. 20), the inflatable roof (see at least FIG. 20), and/or other inflatable physical activity features and interactive devices (see at least FIG. 15); however, this is not required. In another or alternative non-limiting embodiment, the one or more physical activity features and/or one or more interactive devices may be temporarily attached to the inflatable floor, the inflatable walls, the inflatable roof, and/or other inflatable physical activity features and interactive devices such that the obstacle course components may be removed during deconstruction of the inflatable device.

In one non-limiting arrangement of the invention, the one or more interactive devices arranged as an obstacle course can be attached to an interior surface and/or an exterior surface of the inflatable structure 20. As one non-limiting example, the one or more interactive devices can be attached to and extend from the interior and/or exterior surface of at least a portion of the inflatable roof, the one or more inflatable walls, the inflatable floor, other inflatable interactive devices, or combinations thereof. The interactive devices can be attached at any angle to any component of the inflatable structure and may be arranged continuously such that one interactive device may be followed by a second or additional interactive device; however, this is not required.

As can be appreciated, the obstacle course arrangement can include a variety of different forms and/or configurations. The shape and/or size of the obstacle course arrangement may be selected to accommodate a desired number of people, a general skill level of participants, the location of the inflatable structure, etc. and ultimately to accommodate user preference.

The size of the inflatable device is non-limiting. In one non-limiting embodiment of the invention, the inflatable device can optionally have a width of about 12-30 feet, a depth of about 10-100 feet, and a height of about 6-30 feet. In another non-limiting embodiment of the invention, the inflatable device has a width of about 11-19 feet, a depth of about 8-16 feet, and a height of about 6-14 feet. In yet another non-limiting embodiment of the invention, the inflatable device has a width of about 46-54 feet, a depth of about 36-34 feet, and a height of about 16-14 feet.

The inflatable device of the present invention can be designed to accommodate one or more people in and/or about the inflatable device such that the one or more people can learn about and experience martial arts. The inflatable device of the present invention has several advantages in that 1) the inflatable device is relatively inexpensive to operate, 2) can be easily and conveniently inflated and deflated, 3) can be easily and conveniently stored in a small space, 4) can be transported to and used in locations without martial arts dojos, 5) can be configured and/or customized in a variety of shapes and sizes, and/or 6) can be configured and/or customized to provide information other than martial arts information.

One non-limiting embodiment of the present invention can comprise an inflatable device, the inflatable device comprising an inflatable structure and one or more interactive devices, the inflatable structure including an area that is at least partially enclosed, an inflatable floor that at least partially covers an area of ground of the inflatable structure, one or more inflatable walls that at least partially encloses said inflatable structure, and an inflatable roof that at least partially covers the inflatable floor of said inflatable structure, the inflatable device designed to be a portable martial arts training device that can be used to expose individuals to martial arts and to the enjoyment and health and fitness benefits of martial arts programs, the plurality of interactive devices including one or more features selected from the group consisting of a target, an inflatable target, punching and/or kicking target, inflatable punching and/or kicking target, dojos, inflatable dojos, ninjas, inflatable ninjas, ninjas with targets, inflatable ninjas with targets, etc., said inflatable device adapted and/or designed to provide exposure to the public of the benefits of martial arts.

According to one non-limiting aspect of the present invention, a method for setting up an inflatable device that can be used as a martial arts training device can comprise the steps of: transporting an inflatable device comprising an inflatable structure and one or more interactive devices to a desired location; pumping fluid into said inflatable structure to inflate a majority of said inflatable structure; pumping fluid into the one or more interactive devices to inflate a majority of said interactive devices; and, setting up the one or more interactive devices inside and/or outside the inflatable structure. The one or more interactive devices may be placed on and/or attached to the outside surface of the inflatable floor, the outside surface of the inflatable walls, or to the outside surface of the inflatable roof of said inflatable structure, and/or the outside surface of one or more other or additional interactive devices used in conjunction with the inflatable device.

The invention has been described with reference to the preferred embodiment and alternatives thereof. It is believed that many modifications and alterations to the embodiment disclosed will readily suggest themselves to those skilled in the art upon reading and understanding the detailed description of the invention. It is intended to include all such modifications and alterations insofar as they come within the scope of the present invention.

What is claimed:

1. An inflatable device configured to be used as a martial arts training device, said inflatable device comprising an inflatable structure and a plurality of inanimate interactive devices connected to said inflatable structure, said inflatable structure including a floor that is at least partially inflatable, a plurality of inflatable columns extending upwardly from said floor and a plurality of inflatable beams connected to a top or top portion of said columns, said plurality of inanimate interactive devices located on or above said floor and said plurality of inanimate interactive devices configured to be engagable by a person located on said floor of said inflatable structure, one of said plurality of inanimate interactive devices is an object in the form of a person or ninja or an inflatable in the form of a person or ninja, and at least one other of said plurality of inanimate interactive devices is selected from the group consisting of a target, an inflatable target, punching or kicking target, inflatable punching or kicking target, another object in the form of a person or ninja, another inflatable in the form of a person or ninja, an object in the form of a person or ninja with a target, and an inflatable in the form of a person or ninja with a target, a plurality of different shapes of said plurality of inanimate interactive devices is located on an interior of said inflatable structure, at least one of said plurality of inanimate interactive devices is located on said interior of said inflatable structure includes an object in the form of a person or ninja hanging upside-down and positioned above said floor, and at least one of said plurality of inanimate interactive devices includes an inflatable target having a disc shape or cylindrical shape and which is connected to at least one of said columns.

* * * * *